US010102788B2

(12) United States Patent
Yoon et al.

(10) Patent No.: US 10,102,788 B2
(45) Date of Patent: Oct. 16, 2018

(54) DISPLAY DEVICE HAVING WHITE PIXEL AND DRIVING METHOD THEREFOR

(71) Applicant: Samsung Display Co., Ltd., Yongin, Gyeonggi-Do (KR)

(72) Inventors: Seok Kyu Yoon, Asan-si (KR); Sang Uk Lim, Yongin-si (KR)

(73) Assignee: Samsung Display Co., Ltd. (KR)

( * ) Notice: Subject to any disclaimer, the term of this patent is extended or adjusted under 35 U.S.C. 154(b) by 135 days.

(21) Appl. No.: 14/801,659

(22) Filed: Jul. 16, 2015

(65) Prior Publication Data

US 2016/0189591 A1 Jun. 30, 2016

(30) Foreign Application Priority Data

Dec. 26, 2014 (KR) ..... 10-2014-0190801

(51) Int. Cl.

| | |
|---|---|
| ***G09G 3/20*** | (2006.01) |
| ***G09G 3/3225*** | (2016.01) |
| *G09G 3/3208* | (2016.01) |
| *G09G 3/36* | (2006.01) |

(52) U.S. Cl.

CPC ..... *G09G 3/2003* (2013.01); *G09G 3/3225* (2013.01); *G09G 3/3208* (2013.01); *G09G 3/3648* (2013.01); *G09G 2300/0426* (2013.01); *G09G 2300/0443* (2013.01); *G09G 2300/0452* (2013.01)

(58) Field of Classification Search

CPC .. G09G 3/2003; G09G 3/3225; G09G 3/3208; G09G 2300/0443; G09G 3/3648; G09G 2300/0426; G09G 2300/0452

See application file for complete search history.

(56) References Cited

U.S. PATENT DOCUMENTS

| | | | | |
|---|---|---|---|---|
| 6,011,531 | A * | 1/2000 | Mei | G09G 3/20 345/90 |
| 7,570,395 | B2 | 8/2009 | Kurumisawa | |
| 2007/0176859 | A1 * | 8/2007 | Cok | G09G 3/3225 345/76 |
| 2008/0018798 | A1 * | 1/2008 | Park | G09G 3/2003 348/655 |
| 2014/0375922 | A1 * | 12/2014 | Park | G02F 1/136286 349/46 |

(Continued)

FOREIGN PATENT DOCUMENTS

| | | | |
|---|---|---|---|
| KR | 10-2005-0095150 | B1 | 9/2005 |
| KR | 10-2007-0082730 | A | 8/2007 |

(Continued)

*Primary Examiner* — Premal R Patel

(74) *Attorney, Agent, or Firm* — Innovation Counsel LLP

(57) ABSTRACT

Embodiments of the present invention relate to a display device and a driving method thereof. More particularly, embodiments of the present invention relate to a display device including a white pixel, and a method of driving such a display device. A display device according to an exemplary embodiment of the present invention includes a plurality of colored pixels and a white pixel, wherein the colored pixels and the white pixel each include at least one switching element, the colored pixels and the white pixel are disposed to be adjacent to each other so as to collectively have a center, and the switching elements are each positioned proximate to the center.

15 Claims, 20 Drawing Sheets

(56) References Cited

U.S. PATENT DOCUMENTS

2015/0015466 A1* 1/2015 Feng ..... G09G 3/2003 345/77
2015/0035738 A1* 2/2015 Hirota ..... G09G 3/3607 345/88
2015/0221704 A1* 8/2015 Hack ..... H01L 27/3211 362/231
2015/0268774 A1* 9/2015 Xu ..... G02F 1/13338 345/173
2016/0027405 A1* 1/2016 Nakanishi ..... G09G 3/2003 345/590
2016/0056203 A1* 2/2016 Kim ..... G02F 1/133514 257/89
2016/0085116 A1* 3/2016 Iwatsu ..... G02F 1/133555 349/144
2016/0365045 A1* 12/2016 Chen ..... G02F 1/133

FOREIGN PATENT DOCUMENTS

KR 10-2010-0041583 A 4/2010
KR 10-2014-0020120 A 2/2014

* cited by examiner

DISPLAY DEVICE HAVING WHITE PIXEL AND DRIVING METHOD THEREFOR

CROSS-REFERENCE TO RELATED APPLICATION

This application claims priority to, and the benefit of, Korean Patent Application No. 10-2014-0190801 filed in the Korean Intellectual Property Office on Dec. 26, 2014, the entire contents of which are incorporated herein by reference.

BACKGROUND (a) Technical Field

Embodiments of the present invention relate generally to display devices and their driving methods. More particularly, embodiments of the present invention relate to display devices including a white pixel, and their driving methods.

(b) Description of the Related Art

Display devices such as liquid crystal displays (LCDs) and organic light emitting devices generally include a display panel that has known elements that include a plurality of pixels including switching elements and a plurality of signal lines, a gray voltage generator that generates a gray reference voltage, a data driver that uses the gray reference voltage to generate image data signals, and the like.

Each pixel includes at least one switching element and an optical conversion element connected thereto. The optical conversion element may include a liquid crystal capacitor in a case of the liquid crystal display, or may include an organic light emitting element in a case of the organic light emitting device. The optical conversion element may include a pixel electrode connected to the switching element to receive a data voltage, a common electrode for application of a common voltage, and an optical conversion layer positioned therebetween. The optical conversion layer may include a liquid crystal layer in the case of the liquid crystal display, or an organic emission layer in the case of the organic light emitting device.

The pixel electrode may be arranged in a matrix shape, and in this case, the pixel electrode is connected to a switching element such as a thin film transistor (TFT), so as to receive data voltages.

The display device generates these data voltages according to the image signal and respectively applies a data voltage and the common voltage to the pixel electrode and the common electrode, thereby displaying an image through the optical conversion element.

For full color reproduction, a plurality of pixels may include color pixels representing primary colors such as red, green, and blue, for example, a red pixel, a green pixel, and a blue pixel. The red pixel, the green pixel, and the blue pixel each represent a primary color.

However, images displayed using only colored pixels may have undesirably low luminance. Particularly, in the case of liquid crystal displays, since the red pixel, the green pixel, and the blue pixel each include colored filters, a light amount emitted from the backlight unit is reduced while passing through the color filter such that the luminance of the image may be excessively reduced. To solve this problem, the display device may further include a white pixel representing white light, in addition to the colored pixels. For example, in the case of liquid crystal displays, since the white pixel does not include a color filter, the luminance of the image may be increased.

The above information disclosed in this Background section is only for enhancement of understanding of the background of the invention and therefore it may contain information that does not form the prior art that is already known in this country to a person of ordinary skill in the art.

SUMMARY

Embodiments of the present invention increase the transmittance of a display device by effectively disposing one or more signal lines and thin film transistors in the center of a group of color pixels, thus increasing an effective area of light transmission.

The present invention can be embodied by a display device including color pixels such as red pixel, green pixel, a blue pixel and a white pixel and thus is suitable for display of images of various resolution, luminance, and image type, as well as in environments of varying brightness.

Embodiments of the present invention allow for more ready control of color coordinates of a displayed white color.

A display device according to an exemplary embodiment of the present invention includes a plurality of colored pixels and a white pixel, wherein the colored pixels and the white pixel each include at least one switching element, the colored pixels and the white pixel are disposed to be adjacent to each other so as to collectively have a center, and the switching elements are each positioned proximate to the center.

At least one gate line and at least one data line connected to at least one of the switching elements may be further included, the colored pixels and the white pixel may be disposed in an at least approximately quadrangular configuration, the at least one gate line may extend between a first pixel row and a second pixel row of the quadrangular configuration, and the at least one data line may extend between a first pixel column and a second pixel column of the quadrangular configuration.

The at least one of the switching elements may include a plurality of switching elements included in the plurality of colored pixels and the white pixel, respectively.

The colored pixels and the white pixel may each be connected to the gate line and the data line through one switching element.

A display device according to an exemplary embodiment of the present invention includes a plurality of large dots, wherein each large dot includes a first large pixel, a second large pixel, a third large pixel, and a fourth large pixel disposed in an at least approximately quadrangular configuration, the first large pixel includes two first color pixels each representing a first color, one second color pixel representing a second color, and one third color pixel representing a third color, the second large pixel includes two second color pixels, one first color pixel, and one third color pixel, and the third large pixel includes two third color pixels, one first color pixel, and one second color pixel.

The fourth large pixel may include one first color pixel, one second color pixel, one third color pixel, and one white pixel representing a white color.

One first color pixel of the first large pixel, one second color pixel of the second large pixel, one third color pixel of the third large pixel, and the white pixel of the fourth large pixel may be adjacent to each other and may be disposed in an at least approximately quadrangular configuration, thereby forming a fusion large pixel.

In the first large pixel, the two first color pixels may be disposed along a first diagonal direction, and the second color pixel and the third color pixel may be disposed along a second diagonal direction crossing the first diagonal direction.

In the second large pixel, the two second color pixels may be disposed along a first diagonal direction, and the first color pixel and the third color pixel may be disposed along a second diagonal direction crossing the first diagonal direction.

In the third large pixel, the two third color pixels may be disposed along a first diagonal direction, and the first color pixel and the second color pixel may be disposed along a second diagonal direction crossing the first diagonal direction.

In the fourth large pixel, the white pixel and the first color pixel may be disposed along a first diagonal direction, and the second color pixel and the third color pixel may be disposed along a second diagonal direction crossing the first diagonal direction.

The first color may be red, the second color may be green, and the third color may be blue.

A method of driving a display device may be performed with a display device that has a large dot including a first large pixel, a second large pixel, a third large pixel, and a fourth large pixel disposed in an at least approximately quadrangular configuration, wherein the first large pixel includes two first color pixels each representing a first color, one second color pixel representing a second color, and one third color pixel representing a third color, where the second large pixel includes two second color pixels, one first color pixel, and one third color pixel, and the third large pixel includes two third color pixels, one first color pixel, and one second color pixel. The method according to an exemplary embodiment of the present invention includes displaying only a first color of an image signal through the first large pixel, displaying only a second color of the image signal through the second large pixel, and displaying only a third color of the image signal through the third large pixel.

The method may further include displaying only a white color through the fourth large pixel.

The displaying only a first color may further comprise turning on at least one of the two first color pixels of the first large pixel. The displaying only a second color may further comprise turning on at least one of the two second color pixels of the second large pixel. The displaying only a third color may further comprise turning on at least one of the two third color pixels of the third large pixel.

The fourth large pixel may include one first color pixel, one second color pixel, one third color pixel, and one white pixel representing a white color. The displaying only a white color further comprises turning on the white pixel or the first through third color pixels of the fourth large pixel.

A method of driving a display device may be implemented on a device that has a large dot including a first large pixel, a second large pixel, a third large pixel, and a fourth large pixel disposed in an at least approximately quadrangular configuration, wherein the first large pixel includes two first color pixels each representing a first color, one second color pixel representing a second color, and one third color pixel representing a third color, where the second large pixel includes two second color pixels, one first color pixel, and one third color pixel, and the third large pixel includes two third color pixels, one first color pixel, and one second color pixel. The method according to an exemplary embodiment of the present invention includes displaying a plurality of images through the large dot, wherein large dot further comprises a plurality of small dots, and wherein the plurality of images is displayed through the plurality of small dots.

The small dots may each include one first color pixel, one second color pixel, and one third color pixel.

The fourth large pixel may include one white pixel representing a white color, and one of the small dots may further include the white pixel.

The fourth large pixel may include one white pixel representing a white color, and the white pixel may be turned on when the images are displayed through the plurality of dots.

According to an exemplary embodiment of the present invention, in a display device including color pixels having a red pixel, a green pixel, a blue pixel, and a white pixel, the effective area transmitting light is increased by effectively disposing the signal line and the thin film transistor within an area center of a quadrangular grouping of the colored and white pixels.

Also, a display device including color pixels such as a red pixel, a green pixel, a blue pixel, and a white pixel, may display images of various resolutions and the various luminances to be suitable for use in various conditions such as differing resolution, varying surrounding brightness, and varying types of image.

Embodiments of the present invention more readily control the color coordinates of the white displayed by the display device, thereby increasing image quality.

DETAILED DESCRIPTION OF THE EMBODIMENTS

Figure 1:
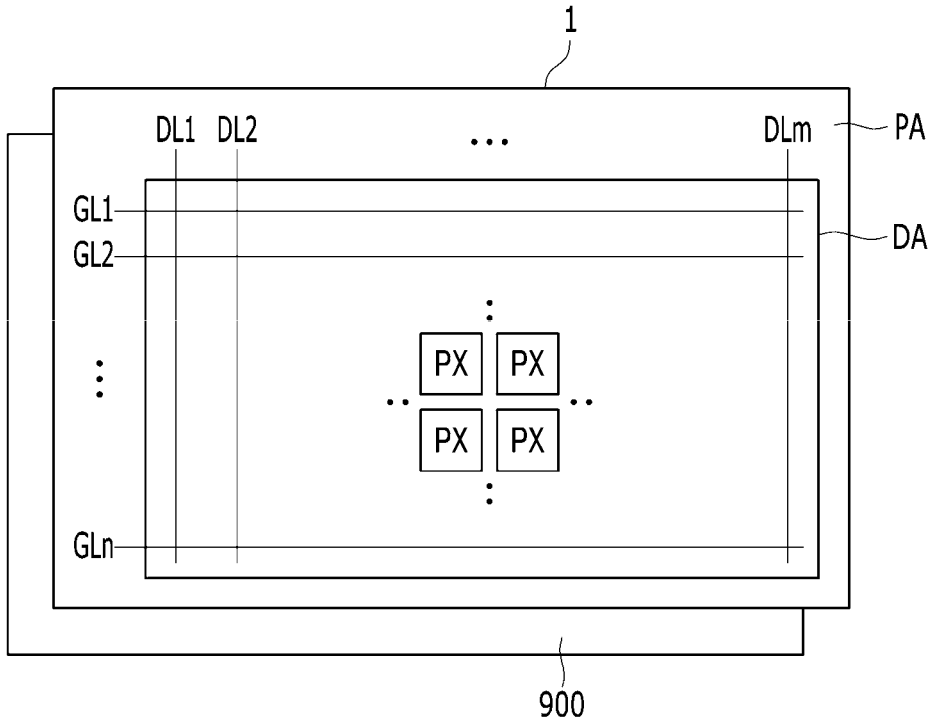
FIG. 1 is a schematic layout view of a display device according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

In the drawings, the thickness of layers, films, panels, regions, etc., are exaggerated for clarity. The Figures are thus not to scale. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

In order to clarify the present invention, parts that are not connected with the description will be omitted, and the same elements or equivalents are referred to with the same reference numerals throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

First, a display device according to an exemplary embodiment of the present invention will be described with reference to FIG. 1 and FIG. 2.

Figure 2:
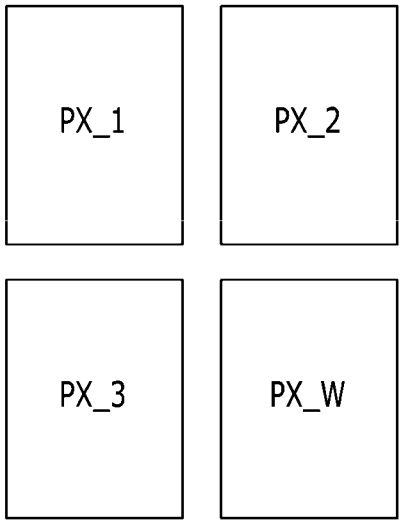
FIG. 2 is a layout view of a plurality of pixels included in a display device according to an exemplary embodiment of the present invention.

FIG. 1 is a schematic layout view of a display device according to an exemplary embodiment of the present invention, and FIG. 2 is a layout view of a plurality of pixels included in a display device according to an exemplary embodiment of the present invention.

Referring to FIG. 1, a display device according to an exemplary embodiment of the present invention may include a display panel 1 and a backlight unit 900 located proximate thereto. The backlight unit 900 may include a backlight (not shown) for emitting light, and at least one optical film (not shown) for improving one or more optical characteristics of the display.

The display panel 1 may include a display area DA which is a region for displaying an image, and a peripheral area PA positioned at a circumference of the display area DA. The display area DA may include a plurality of signal lines GL1, GL2, . . . , GLn, DL1, DL2, . . . , DLm and a plurality of pixels PX connected thereto.

The signal lines GL1, GL2, . . . , GLn, DL1, DL2, . . . , DLm may include a plurality of gate lines GL1, GL2, . . . , GLn for transmitting a gate signal and a plurality of data lines DL1, DL2, . . . , DLm for transmitting a data voltage. The gate lines GL1, GL2, . . . , GLn mainly extend generally in a horizontal direction and the data lines DL1, DL2, . . . , DLm may extend generally in a vertical direction thereby crossing the gate lines GL1, GL2, . . . , GLn.

The plurality of pixels PX may be arranged in a matrix (i.e. regularly-spaced rows and columns), however they are not limited thereto. Any arrangement and positions are contemplated Referring to FIG. 2, the plurality of pixels PX includes a plurality of color pixels PX_1, PX_2, and PX_3 and a white pixel PX_W.

The plurality of color pixels PX_1, PX_2, and PX_3 may display three primary colors such as red, green and blue, or four primary colors. The primary colors are not limited to red, green, and blue and may be any other set of primary colors, such as cyan, magenta, and yellow. The plurality of color pixels according to an exemplary embodiment of the present invention may include a first color pixel PX_1, a second color pixel PX_2, and a third color pixel PX_3. In the present exemplary embodiment, the first color pixel PX_1 is a red pixel representing red, the second color pixel PX_2 is a green pixel representing green, and the third color pixel PX_3 is a blue pixel representing blue.

The white pixel PX_W passes substantially all light in the visible ray wavelength band instead of passing light of just one color, thereby displaying white. The white pixel PX_W has a function of improving color reproducibility of the display device and increasing luminance.

The plurality of adjacent color pixels PX_1, PX_2, and PX_3 displays each primary color and thus full colors may be recognized as the color-space sum of the primary colors.

When the plurality of adjacent color pixels PX_1, PX_2, and PX_3 are turned on to display the image, the white pixel PX_W adjacent thereto is also driven, thereby increasing the luminance of the displayed image. When displaying a white color image, only the white pixel PX_W may be driven, only pixels PX_1, PX_2, and PX_3 may be driven, or all pixels PX_1, PX_2, PX_3, and PX_W may be driven.

Various arrangements of the plurality of color pixels PX_1, PX_2, and PX_3 and the white pixel PX_W may be employed, besides the one shown in FIG. 2.

Referring to FIG. 2, the four pixels PX_1, PX_2, and PX_3 and PX_W may be arranged in an approximate quadrangle matrix shape or configuration. For example, the four pixels PX_1, PX_2, and PX_3 and PX_W may be arranged as a 2×2 matrix. In this 2×2 matrix, the first color pixel PX_1 and the white pixel PX_W may be disposed diagonally opposite to each other, and the second color pixel PX_2 and the third color pixel PX_3 may also be disposed diagonally opposite to each other. Also, the first color pixel PX_1 and the third color pixel PX_3 may be adjacent in (both placed along) the column or vertical direction, and the second color pixel PX_2 and the white pixel PX_W may be adjacent in (both placed along) the column or vertical direction. Further, the first color pixel PX_1 and the second color pixel PX_2 may be adjacent in (both placed along) the row or horizontal direction, and the third color pixel PX_3 and the white pixel PX_W may be adjacent in (both placed along) the row or horizontal direction.

This pixel arrangement may be uniform across the display area DA, or may vary by position within area DA in any manner.

Next, a display device according to an exemplary embodiment of the present invention as described above will be described with reference to FIG. 3 to FIG. 7.

Figure 3:
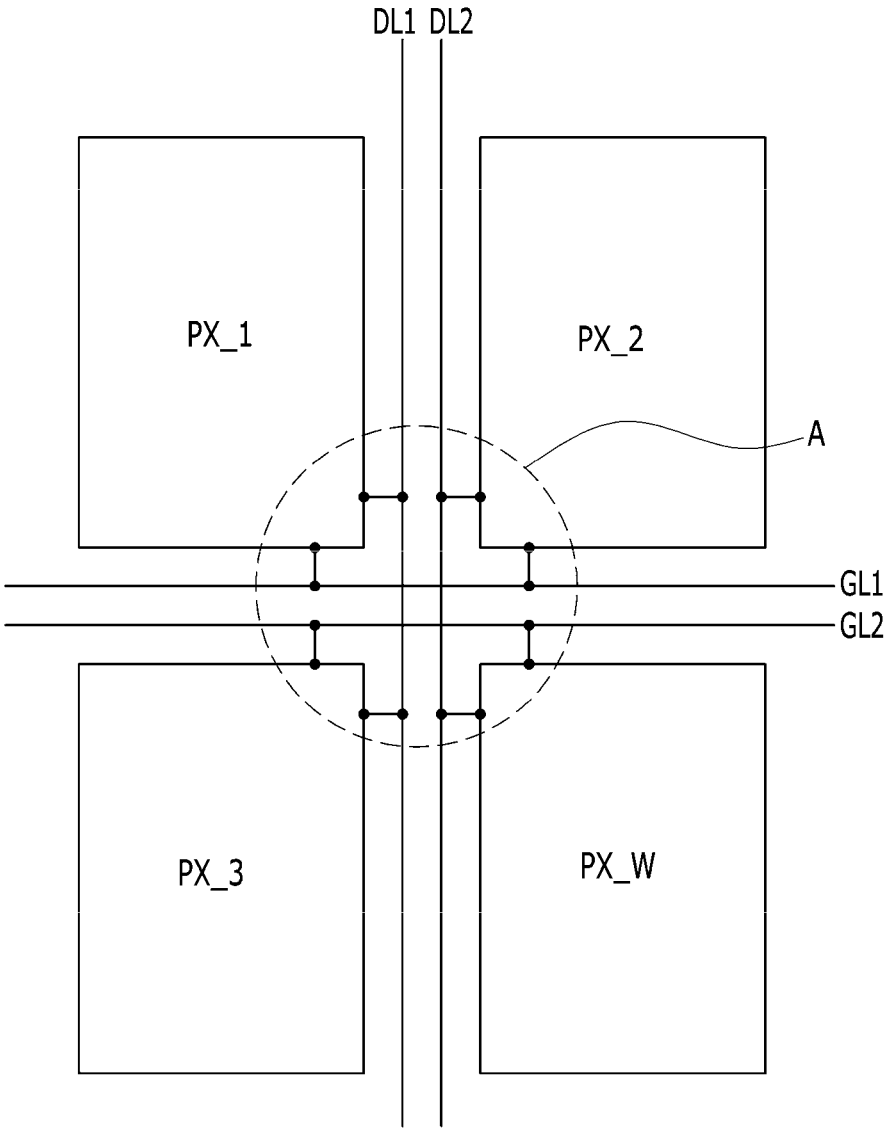
FIG. 3 is a layout view of a plurality of pixels and signal lines included in a display device according to an exemplary embodiment of the present invention.
Figure 4:
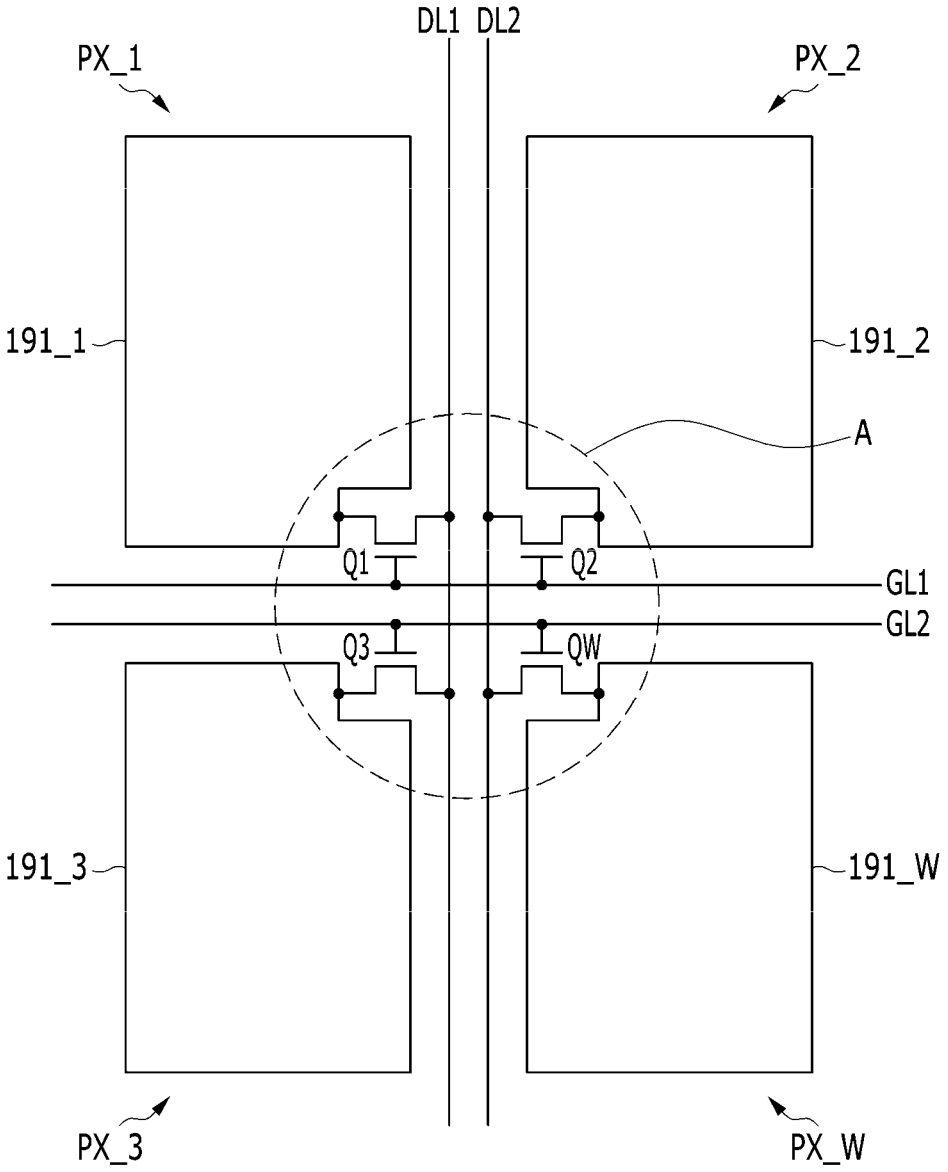
FIG. 4 is a layout view of a plurality of pixels and signal lines and switching elements connected thereto included in a display device according to an exemplary embodiment of the present invention.
Figure 5:
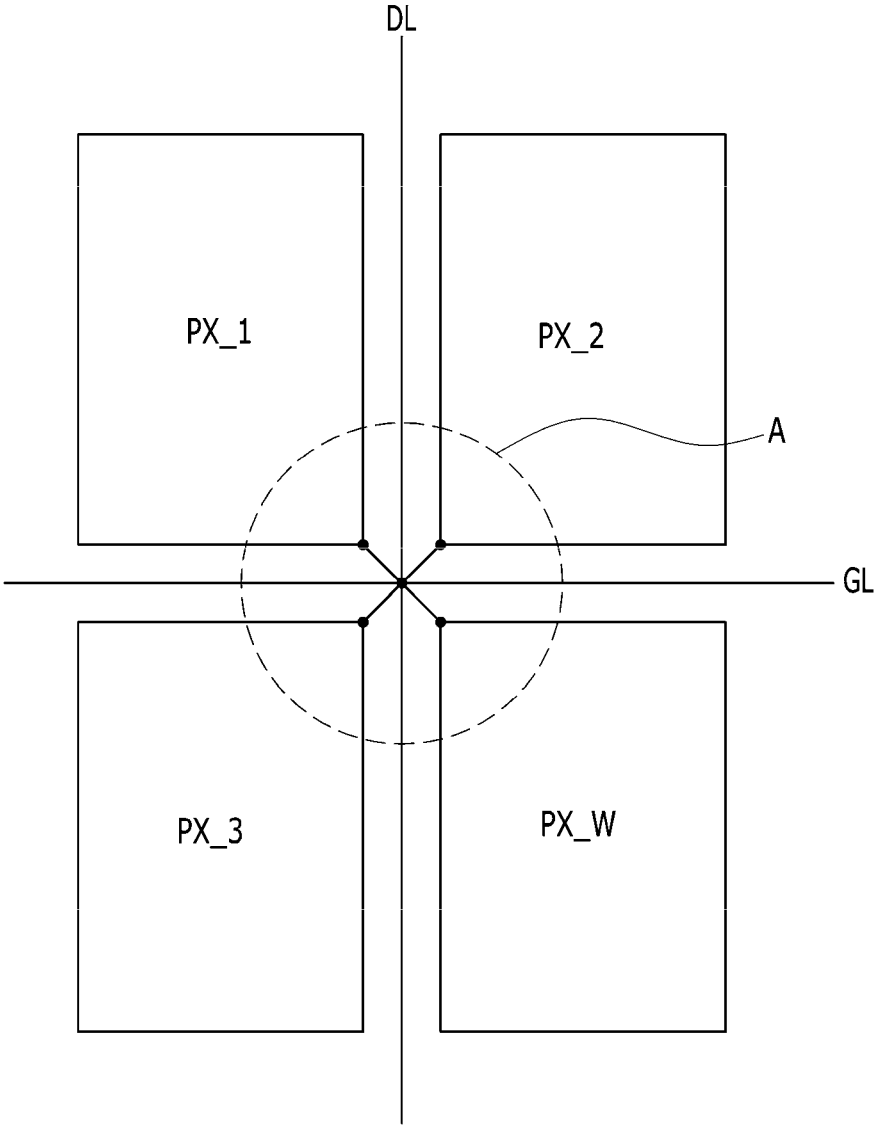
FIG. 5 is a layout view of a plurality of pixels and signal lines included in a display device according to an exemplary embodiment of the present invention.
Figure 6:
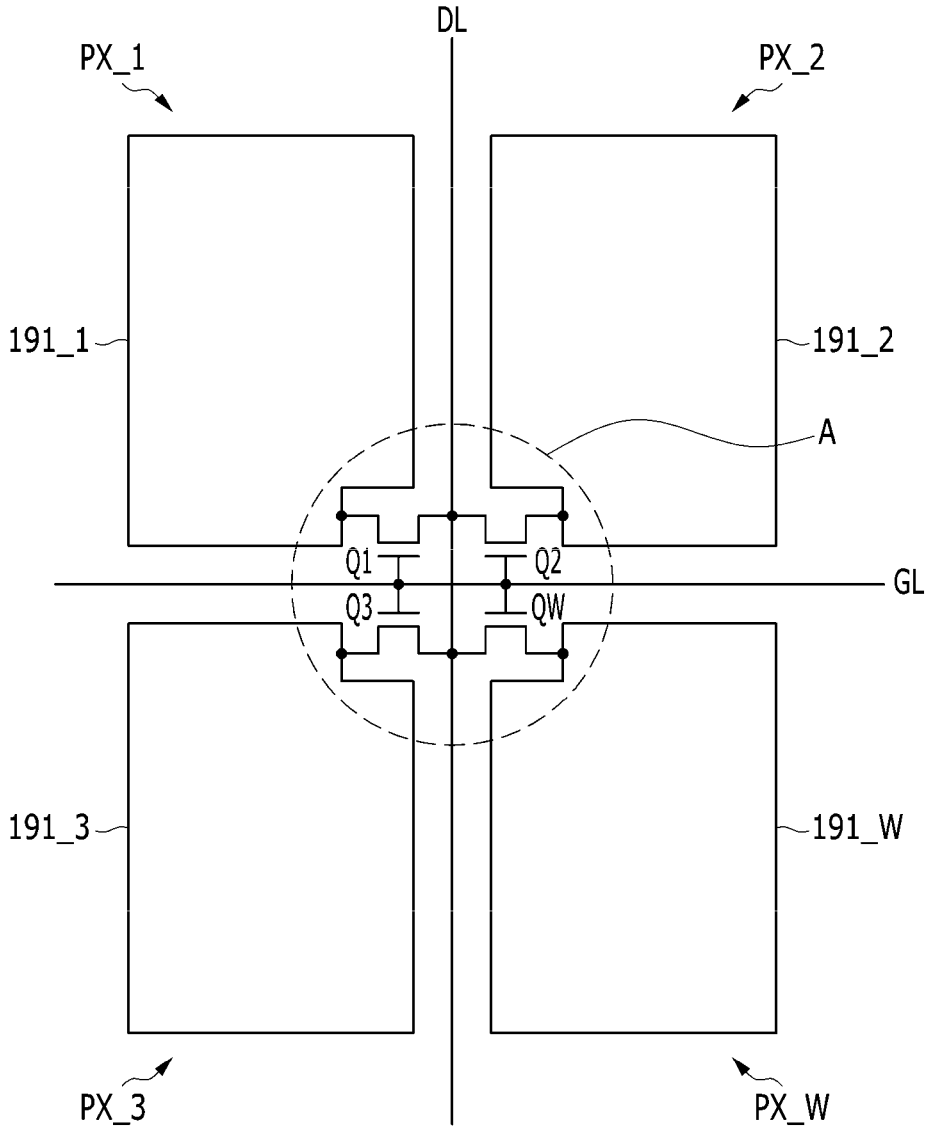
FIG. 6 and FIG. 7 are layout views of a plurality of pixels and signal lines and switching elements connected thereto included in a display device according to an exemplary embodiment of the present invention.
Figure 7:
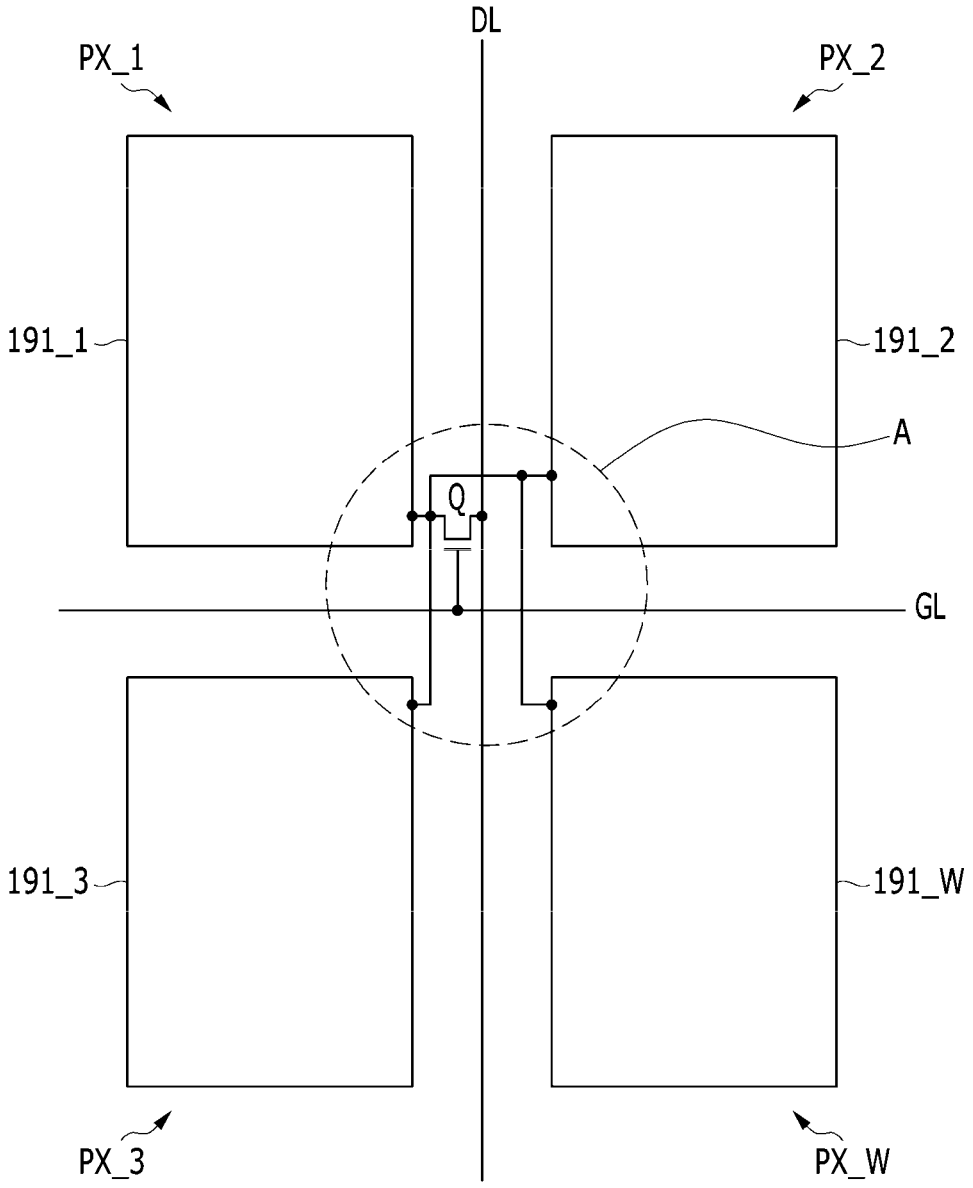

FIG. 3 is a layout view of a plurality of pixels and signal lines included in a display device according to an exemplary embodiment of the present invention. FIG. 4 is a layout view of a plurality of pixels and signal lines, and switching elements connected thereto, included in a display device according to an exemplary embodiment of the present invention. FIG. 5 is a layout view of a plurality of pixels and signal lines included in a display device according to an exemplary embodiment of the present invention. FIG. 6 and FIG. 7 are layout views of a plurality of pixels and signal lines, and switching elements connected thereto, included in a display device according to an exemplary embodiment of the present invention.

First, referring to FIG. 3, the display device according to an exemplary embodiment of the present invention includes the plurality of signal lines GL1, GL2, DL1, and DL2, as well as the plurality of color pixels PX_1, PX_2, and PX_3 and the white pixel PX_W connected thereto.

The first color pixel PX_1, the second color pixel PX_2, the third color pixel PX_3, and the white pixel PX_W may be arranged together in an approximate quadrangle-shaped matrix. For example, the first color pixel PX_1 and the second color pixel PX_2 may be disposed adjacent to each other in a first or upper row, and the third color pixel PX_3 and the white pixel PX_W may be disposed adjacent to each other in a second or lower row. The first color pixel PX_1 and the third color pixel PX_3 may be disposed in the first or leftmost column, and the second color pixel PX_2 and the white pixel PX_W may be disposed in the second or rightmost column. Accordingly, the inner corners of four pixels PX_1, PX_2, PX_3, and PX_W may point toward one point, as is shown in region A of FIG. 3. That is, four pixels PX_1, PX_2, PX_3, and PX_W may be disposed to be adjacent to each other with the region A as a center.

The signal lines GL1, GL2, DL1, and DL2 may include the first and second gate lines GL1 and GL2 for transmitting gate signals, and the first and second data lines DL1 and DL2 for transmitting data voltages.

The first and second gate lines GL1 and GL2 mainly extend in the horizontal direction, and the first and second data lines DL1 and DL2 mainly extend in the vertical direction thereby crossing the first and second gate lines GL1 and GL2. The first and second gate lines GL1 and GL2 may be disposed between the first and second pixel rows and extend in the row direction, that is, the horizontal direction, and the first and second data lines DL1 and DL2 may be disposed between the first and second pixel columns and extend in the column direction, that is, the vertical direction.

The region between the pixels PX_1, PX_2, PX_3, and PX_W and/or regions with signal lines therein may be covered by a light blocking member (not shown), and portions that are not covered by a light blocking member may form a transmission region in which the light may be transmitted and the image may be displayed.

The pixels PX_1, PX_2, PX_3, and PX_W may be respectively connected to the different gate lines GL1 and GL2 and data lines DL1 and DL2. Accordingly, each of the pixels PX_1, PX_2, PX_3, and PX_W may be independently charged with the data voltage at independent timing. The area in the middle of the pixels PX_1, PX_2, PX_3, and PX_W, at the intersection of the gate lines GL1 and GL2 and the data lines DL1 and DL2, may be positioned at region A, as shown in FIG. 3.

Embodiments of region A will be described with reference to FIG. 4 along with FIG. 3.

Referring to FIG. 3 and FIG. 4, each of the pixels PX_1, PX_2, PX_3, and PX_W may include at least one switching element Q1, Q2, Q3, and QW connected to at least one data line DL1 and DL2 and at least one gate line GL1 and GL2, with at least one pixel electrode 191_1, 191_2, 191_3, and 191_W connected thereto. The switching elements Q1, Q2, Q3, and QW may include at least one thin film transistor. The thin film transistor is controlled according to the gate signal transmitted by the gate lines GL1 and GL2, to transmit the data voltage transmitted by the data lines DL1 and DL2 to the pixel electrodes 191_1, 191_2, 191_3, and 191_W. Most of the pixel electrodes 191_1, 191_2, 191_3, and 191_W are positioned in the transmission regions of the respective pixels PX_1, PX_2, PX_3, and PX_W, thereby controlling the display of the image.

The switching elements Q1, Q2, Q3, and QW of the pixels PX_1, PX_2, PX_3, and PX_W are positioned within the region A. As described above, when disposing four pixels PX_1, PX_2, PX_3, and PX_W in one quadrangle-shaped matrix to be adjacent to each other, the size of the light-blocking region may be minimized by disposing the switching elements Q1, Q2, Q3, and QW included in the four adjacent pixels PX_1, PX_2, PX_3, and PX_W in the center of area of the four pixels PX_1, PX_2, PX_3, and PX_W, that is, the region A. Likewise, by disposing the signal lines so that pairs or more of the gate lines GL1 and GL2 and the data lines DL1 and DL2 are adjacent to each other and positioned between successive pixel columns or pixel rows, the light blocking region may be minimized. Accordingly, as the display device further includes the white pixel PX_W as well as color pixels such as a red pixel, a green pixel, and a blue pixel, the effective area that passes light is increased, thereby increasing the transmittance of the display device.

Next, referring to FIG. 5, the display device according to a further exemplary embodiment is similar to the display device according to the exemplary embodiment shown in FIG. 3, except for the signal lines and the connection relation between the signal lines and the pixels PX_1, PX_2, PX_3, and PX_W.

One gate line GL is disposed between the first pixel row and the second pixel row formed by four pixels PX_1, PX_2, PX_3, and PX_W to extend in the horizontal direction, and one data line DL is disposed between the first pixel column and the second pixel column to extend in the column direction, that is, the vertical direction.

According to the present exemplary embodiment, at least two of the pixels PX_1, PX_2, PX_3, and PX_W are connected to the same gate line GL and/or the same data line DL. FIG. 5 shows an example in which all pixels PX_1, PX_2, PX_3, and PX_W disposed in one 2×2 quadrangle-shaped matrix are connected to one gate line GL and one data line DL. Accordingly, at least two of the pixels PX_1, PX_2, PX_3, and PX_W may have the same data voltage applied thereto, at the same timing. The connections of the pixels PX_1, PX_2, PX_3, and PX_W to the gate line GL and the data line DL may be located in the region A, as shown in FIG. 5.

This region A will be further described with reference to FIG. 6 as well as FIG. 5.

Referring to FIG. 5 and FIG. 6, each of the pixels PX_1, PX_2, PX_3, and PX_W may include at least one switching element Q1, Q2, Q3, and QW connected to the data line DL and the gate line GL, and at least one pixel electrode of 191_1, 191_2, 191_3, and 191_W connected thereto. The switching elements Q1, Q2, Q3, and QW may include at least one thin film transistor. Accordingly, the switching elements Q1, Q2, Q3, and QW included in at least two of the pixels PX_1, PX_2, PX_3, and PX_W are controlled by the gate signal transmitted by the gate line GL, such that the data voltage transmitted by the data line DL may be transmitted to the pixel electrodes 191_1, 191_2, 191_3, and 191_W.

In the present exemplary embodiment, the switching elements Q1, Q2, Q3, and QW of the pixels PX_1, PX_2, PX_3, and PX_W are all positioned in the region A. As described above, when disposing four pixels PX_1, PX_2, PX_3, and PX_W in one quadrangle-shaped matrix to be adjacent to each other, the size of the light-blocking region may be minimized by disposing the switching elements Q1, Q2, Q3, and QW included in the four adjacent pixels PX_1, PX_2, PX_3, and PX_W together in one corner shared by the four pixels PX_1, PX_2, PX_3, and PX_W, that is, the region A. Likewise, by using a minimum number of signal lines (here, one gate line GL and one data line DL) for four pixels PX_1, PX_2, PX_3, and PX_W, the size of the light blocking region may be minimized. Accordingly, although the display device further includes the white pixel PX_W as well as color pixels, the effective area passing light is increased, thereby increasing the transmittance of the display device.

Referring to FIG. 7, the display device according to another exemplary embodiment is similar to the display device according to the exemplary embodiment shown in FIG. 6, except that each switching element of the pixels PX_1, PX_2, PX_3, and PX_W does not include a separate thin film transistor. Instead, each group of four pixels PX_1, PX_2, PX_3, and PX_W includes three or fewer thin film transistors. FIG. 7 is an example in which four pixels PX_1, PX_2, PX_3, and PX_W are all connected to one switching element including one thin film transistor. In this case, four adjacent pixels PX_1, PX_2, PX_3, and PX_W include one switching element Q, so that the total area which can transmit light is further increased in the display device, thereby increasing the transmittance of the display device.

Figure 8:
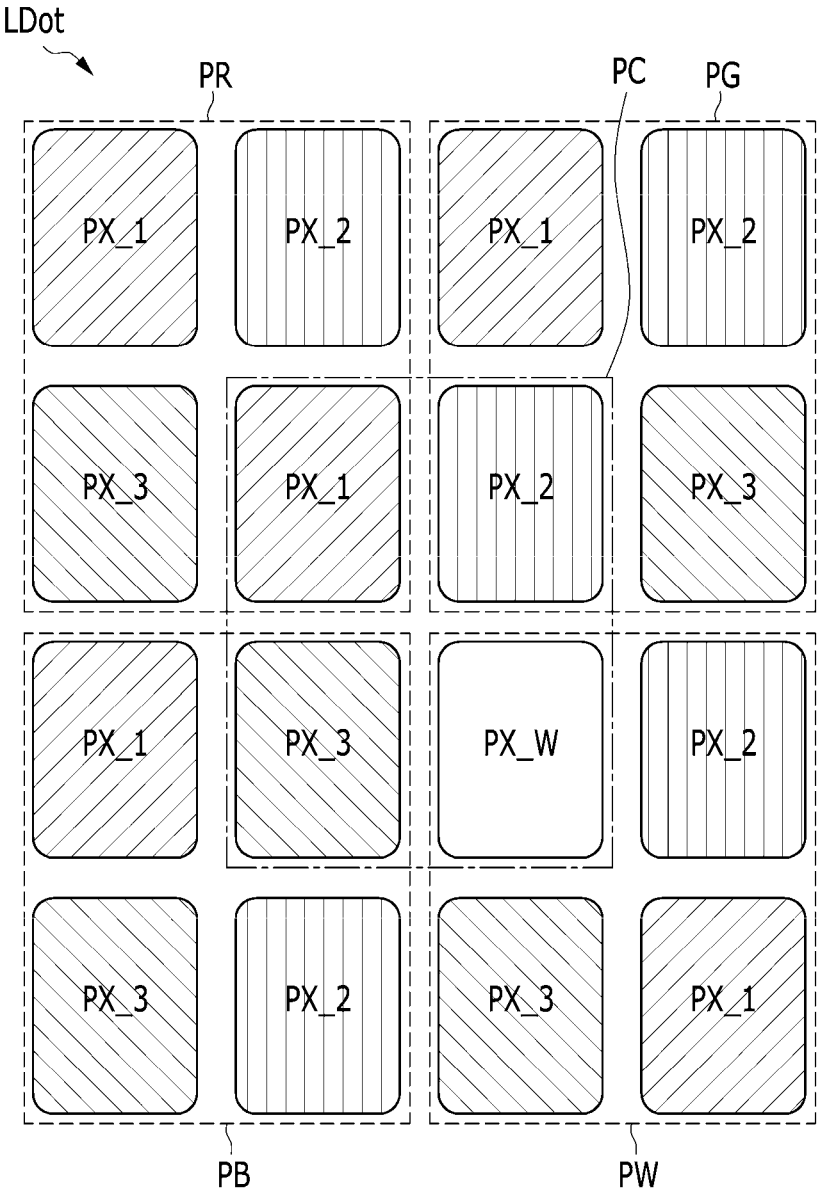
FIG. 8 and FIG. 9 are layout views of a plurality of pixels included in a display device according to an exemplary embodiment of the present invention.
Figure 9:
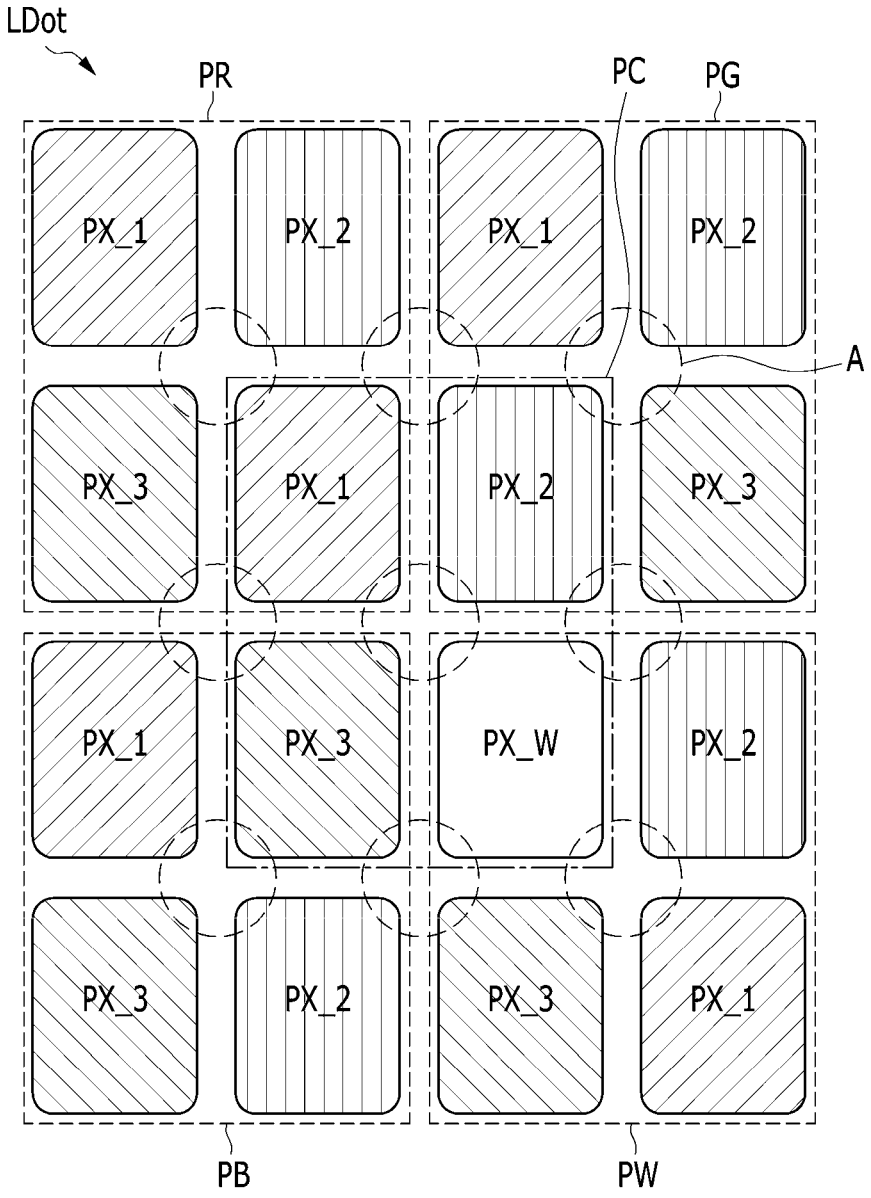

Next, a pixel arrangement and method of driving the display device according to an exemplary embodiment of the present invention will be described with reference to FIG. 8 and FIG. 9. FIG. 8 and FIG. 9 are layout views of a plurality of pixels included in a display device according to a further exemplary embodiment of the present invention, Referring to FIG. 8, as described above, the display device according to an exemplary embodiment of the present invention includes color pixels PX_1, PX_2, and PX_3 and white pixel PX_W, and may form one large dot LDot. In the present exemplary embodiment, the large dot LDot includes the 16 pixels shown, but the number of pixels PX_1, PX_2, PX_3, PX_W included in the large dot LDot is not limited to 16, and may vary. A display device according to an exemplary embodiment of the present invention may include a plurality of large dots LDot, and each large dot LDot may have various configurations exemplified by the several exemplary embodiments that will be described below. Also, large dots LDot in different positions within the display may have differing structures. That is, one display may have large dots LDot that differ from each other.

One large dot LDot substantially includes four large pixels or pixel groups PR, PG, PB, and PW. The large pixels PR, PG, PB, and PW include a first large pixel PR, a second large pixel PG, a third large pixel PB, and a fourth large pixel PW. Each of the large pixels PR, PG, PB, and PW may include four pixels of types selected from among pixels PX_1, PX_2, PX_3, and PX_W, and multiple pixels of the same color may be included in the same large pixel. Four pixels included in each of the large pixels PR, PG, PB, and PW may be disposed substantially in a quadrangle-shaped matrix form.

In detail, the first large pixel PR may include two first color pixels PX_1, one second color pixel PX_2, and one third color pixel PX_3. The two first color pixels PX_1 may be disposed along one diagonal direction, and the rest of the pixels may be disposed along the opposite diagonal direction.

The second large pixel PG may include two second color pixels PX_2, one first color pixel PX_1, and one third color pixel PX_3. The two second color pixels PX_2 may be disposed along one diagonal direction, and the rest of the pixels may be disposed along the opposite diagonal direction.

The third large pixel PB may include two third color pixels PX_3, one first color pixel PX_1, and one second color pixel PX_2. The two third color pixels PX_3 may be disposed along one diagonal direction, and the rest of the pixels may be disposed along the opposite diagonal direction.

The fourth large pixel PW may include one white pixel PX_W, one first color pixel PX_1, one second color pixel PX_2, and one third color pixel PX_3. The white pixel PX_W and one of the color pixels PX_1, PX_2, and PX_3 may be disposed along one diagonal direction, and the other two color pixels may be disposed along the opposite diagonal direction.

As described above, the plurality of large pixels PR, PG, PB, and PW included in one large dot LDot may be disposed substantially in a quadrangle-shaped matrix form, and the plurality of pixels PX_1, PX_2, PX_3, and PX_W included in each large pixel PR, PG, PB, and PW may also be disposed substantially in a quadrangle-shaped matrix form. However, embodiments of the invention are not limited to this configuration. Large dot LDot may comprise any number, type, and arrangement of large pixels PR, PG, PB, and PW, which in turn may comprise any number, type, and arrangement of pixels. That is, the arrangement of the pixels PX_1, PX_2, PX_3, and PX_W included in each of the large pixels PR, PG, PB, and PW may vary, and the arrangement of the large pixels PR, PG, PB, and PW included in the large dot LDot may also vary.

Each of the large pixels PR, PG, PB, and PW may display one of the primary colors represented by each of the color pixels PX_1, PX_2, and PX_3 or may display a white color. When each of the large pixels PR, PG, PB, and PW displays a white color, the color pixels PX_1, PX_2, and PX_3 included in each of the large pixels PR, PG, PB, and PW may be turned on. When each of the large pixels PR, PG, PB, and PW displays red, only the first color pixel PX_1 included in each of them may be turned on. Similarly, when displaying green, only the second color pixel PX_2 included in each of them may be turned on, and when displaying blue, only the third color pixel PX_3 included in each of them may be turned on. In the case that the large pixel includes a pair of pixels of one primary color, two pixels representing the primary color may be turned on or only one may be turned on.

When the fourth large pixel PW represents one of the primary colors, by also turning on the white pixel PX_W, the luminance of the image may be increased.

According to an exemplary embodiment of the present invention, four pixels PX_1, PX_2, PX_3, and PX_W arranged as a plurality of large pixels PR, PG, PB, and PW form one large dot LDot that includes one fusion large pixel PC. The first color pixel PX_1 of the fusion large pixel PC corresponds to the first large pixel PR, the second color pixel PX_2 of the fusion large pixel PC corresponds to the second large pixel PG, the third color pixel PX_3 of the fusion large pixel PC corresponds to the third large pixel PB, and the white pixel PX_W of the fusion large pixel PC corresponds to the fourth large pixel PW.

Accordingly, the fusion pixel PC may display one of the primary colors represented by the color pixels PX_1, PX_2, and PX_3 and may also display a white color.

Referring to FIG. 9, the pixels PX_1, PX_2, PX_3, and PX_W included in the large dot LDot may be connected to the signal lines through the switching elements as described above, and the switching elements may be positioned at each region A located at the intersection of four adjacent pixels. This was described above such that the detailed description is omitted.

As described above, since the large pixels PR, PG, PB, and PW and/or the fusion large pixel PC may freely display the various images having various resolutions and various luminances, the kind of image displayed by the display device may be maximized, and the white color coordinate may be relatively readily controlled.

Next, FIG. 10 to FIG. 20 will be described in detail along with FIG. 8 and FIG. 9.

FIG. 10, FIG. 11, FIG. 12, FIG. 13, FIG. 14, and FIG. 15 are layout views showing an example of a pixel that is driven when large dots of a display device according to further exemplary embodiments of the present invention display one image, respectively, and FIG. 16, FIG. 17, FIG. 18, FIG. 19, and FIG. 20 are layout views showing an example of a pixel that is driven when large dots of a display device according to further exemplary embodiments of the present invention display a plurality of images, respectively.

Figure 10:
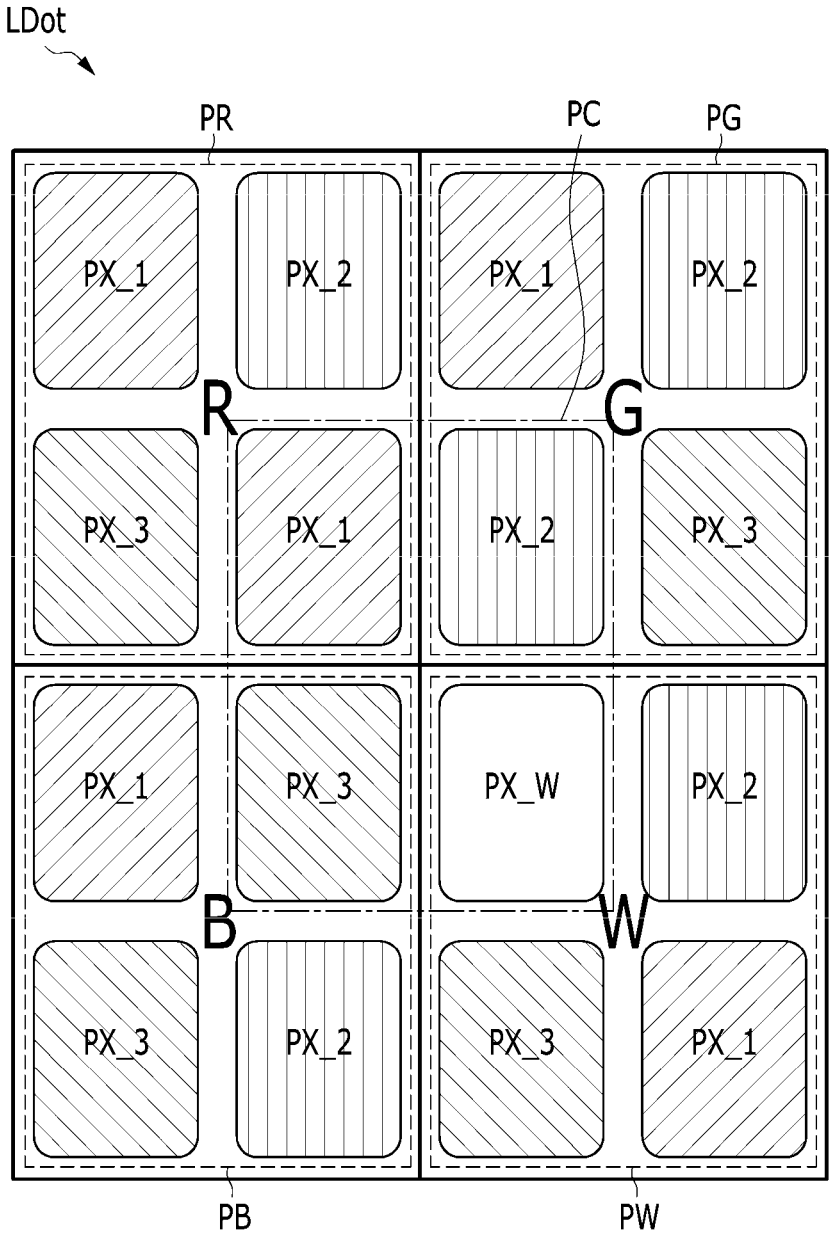
FIG. 10, FIG. 11, FIG. 12, FIG. 13, FIG. 14, and FIG. 15 are layout views showing an example of a pixel that is driven when a large dot of a display device according to an exemplary embodiment of the present invention displays one image, respectively.

First, referring to FIG. 10, one large dot LDot may display one image corresponding to an image signal. In this case, the first large pixel PR included in one large dot LDot represents the red R of the corresponding image, the second large pixel PG represents the green G of the corresponding image, and the third large pixel PB represents the blue B of the corresponding image. The fourth large pixel PW may have the function of increasing the luminance of the corresponding image representing the white color W. The red R represented by the first large pixel PR, the green G represented by the second large pixel PG, and the blue B represented by the third large pixel PB are appropriately combined by, for example, various known methods, thereby displaying an image having various colors.

In this case, at least one of the two first color pixels PX_1 included in the first large pixel PR may be turned on to represent red R. The degree of saturation of the red color may be controlled by controlling the number of first color pixels PX_1 that are turned on. The turned-on first color pixel PX_1 may not be included in the fusion large pixel PC. The second color pixel PX_2 and third color pixel PX_3 that are included together in the first large pixel PR may also be turned on. In this case, since three color pixels PX_1, PX_2, and PX_3 in the first large pixel PR are turned on, they may represent a white color and the luminance of the red represented by the first large pixel PR may be increased.

Likewise, at least one of the two second color pixels PX_2 included in the second large pixel PG may be turned on, thereby representing the green G. Saturation of the green may be controlled by controlling the number of pixels PX_2 that are turned on. The turned on second color pixel PX_2 may not be included in the fusion large pixel PC. The first color pixel PX_1 and the third color pixel PX_3 that are included together in the second large pixel PG may also be turned on. In this case, since three color pixels PX_1, PX_2, and PX_3 in the second large pixel PG are turned on, they may represent a white color and the luminance of the green represented by the second large pixel PR may be increased.

Likewise, at least two of the third color pixels PX_3 included in the third large pixel PB may be turned on, thereby representing the blue B. The degree of saturation of the blue may be controlled by controlling the number of pixels PX_3 that are turned on. The turned-on third color pixel PX_3 may not be included in the fusion large pixel PC. The first color pixel PX_1 and the second color pixel PX_2 that are included together in the third large pixel PB may also be turned on. In this case, since three color pixels PX_1, PX_2, and PX_3 in the third large pixel PB are turned on, they may represent a white color and the luminance of the blue represented by the third large pixel PB may be increased.

The fourth large pixel PW may be turned on or off as desired. When turned on, the white color W is represented such that the luminance of the image represented by the large dot LDot may be increased and the luminance may also be more readily controlled. When the fourth large pixel PW is turned on, only the white pixel PX_W included in the fourth large pixel PW may be turned on, or the three color pixels PX_1, PX_2, and PX_3 may be simultaneously turned on, or all pixels PX_1, PX_2, PX_3, and PX_W included in the fourth large pixel PW may be turned on. Each of these cases represents the white color W. One of ordinary skill in the art will understand that the fourth large pixel PW allows for emission of a desired amount of white light W which can be adjusted in known manner. Thus, use of the fourth large pixel PW allows for adjustment of the luminance of the displayed image as desired. In this manner, for example, the luminance of the displayed image may be adjusted to compensate for the type of image displayed, ambient light levels, and the like.

Also, the color coordinates of the white color represented by only turning on the color pixels PX_1, PX_2, and PX_3 in the fourth large pixel PW may be different from the color coordinates of the white color represented by only turning on the white pixel PX_W. Accordingly, as described above, the color coordinates of the white color when only turning on the white pixel PX_W, the color coordinates of the white color when only turning on the three color pixels PX_1, PX_2, and PX_3, and the color coordinates of the white color when turning on all pixels PX_1, PX_2, PX_3, and PX_W may be different from each other. Thus, the color coordinate of the displayed white may be readily controlled depending on the various driving methods, thereby allowing for display of whites of differing color coordinates as desired.

Figure 11:
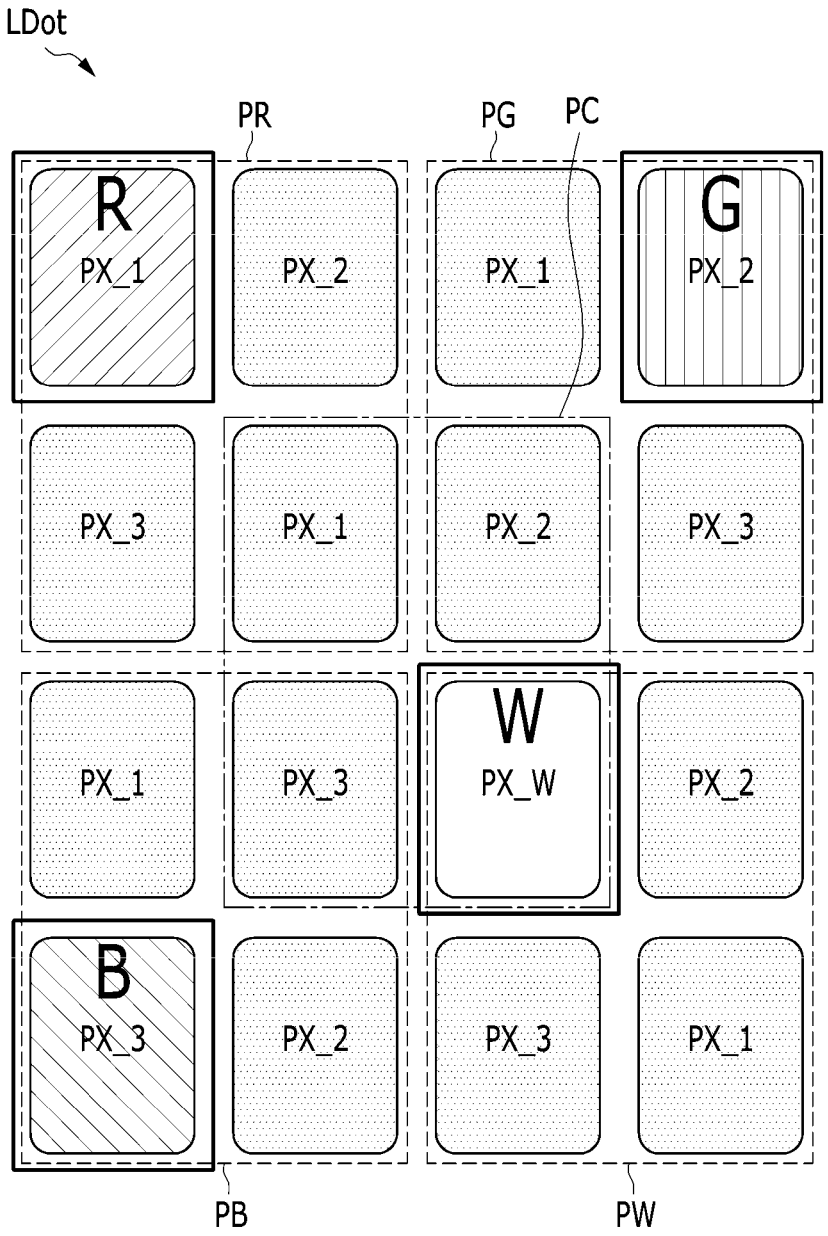

Next, referring to FIG. 11, a method of driving a display device according to an additional exemplary embodiment is similar to that of the exemplary embodiment shown in FIG. 10, however only one of the pixels PX_1, PX_2, PX_3, and PX_W is turned on in each of the large pixels PR, PG, PB, and PW to display one image corresponding to one image signal for one large dot LDot.

In detail, one of the two first color pixels PX_1 included in the first large pixel PR is turned to represent the red R, and the rest of the color pixels PX_1, PX_2, and PX_3 may be turned off. One of the two second color pixels PX_2 included in the second large pixel PG is turned to represent the green G, and the rest of the color pixels PX_1, PX_2, and PX_3 may be turned off. One of the two third color pixels PX_3 included in the third large pixel PB is turned on to represent the blue B, and the rest of the color pixels PX_1, PX_2, and PX_3 may be turned off. The white pixel PX_W of the fourth large pixel PW is turned on to represent the white color W.

As described above, the red R represented by the first large pixel PR, the green G represented by the second large pixel PG, and the blue B represented by the third large pixel PB are appropriately combined in various ways and in known manner, thereby displaying images of various colors, and the white color represented by the white pixel PX_W of the fourth large pixel PW may increase the luminance of these images.

Figure 12:
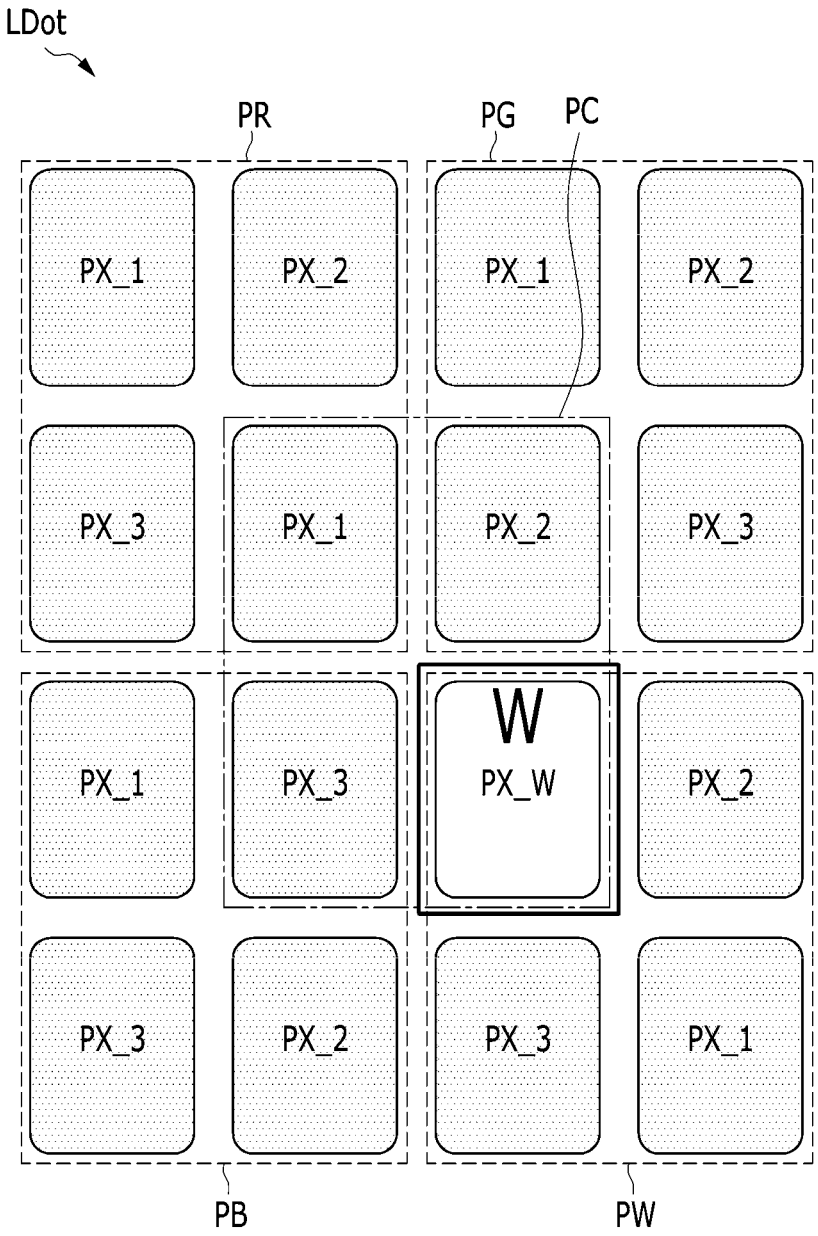

Next, referring to FIG. 12, a method of driving a display device according to a further exemplary embodiment is similar to the exemplary embodiment shown in FIG. 11, however only white pixel PX_W is driven within large dot LDOT, such as when displaying a white color-based image.

Figure 13:
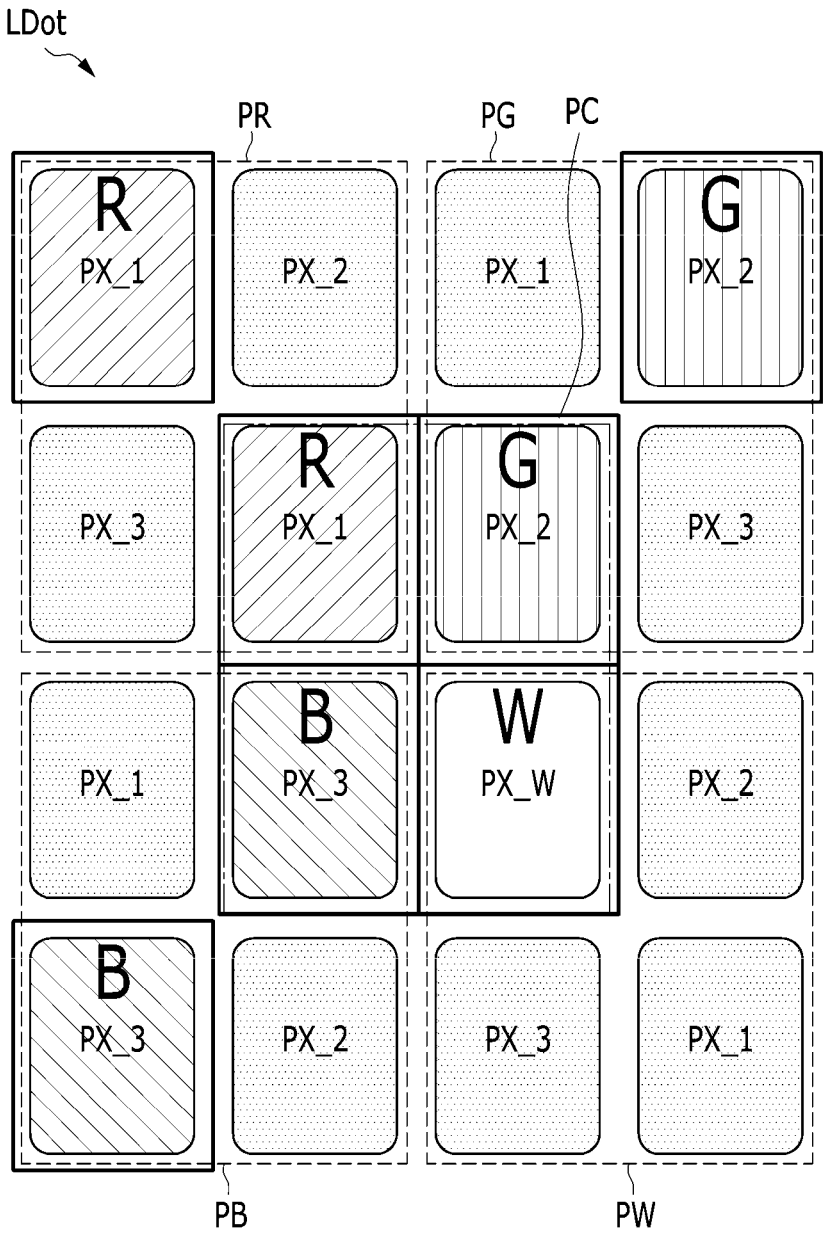

Next, referring to FIG. 13, a method of driving a display device according to a still further exemplary embodiment is similar to that of the exemplary embodiment shown in FIG. 11, however pair of color pixels PX_1, PX_2, and PX_3 representing the same primary color are driven in the respective first to third large pixels PR, PG, and PB to display an image on large dot LDot.

In detail, two first color pixels PX_1 included in the first large pixel PR may together represent the red R, two second color pixels PX_2 included in the second large pixel PG may together represent the green G, and two third color pixels PX_3 included in the third large pixel PB may together represent the blue B.

Accordingly, an image of higher saturation than that of the exemplary embodiment shown in FIG. 11 may be displayed, and different white color coordinates from those of FIG. 11 or FIG. 12 may be represented. That is, when one large dot LDot displays a white color-based image, a ratio of the white displayed by the white pixel PX_W and the white displayed by the color pixels PX_1, PX_2, and PX_3 may be adjusted by using various mixes of the different methods of FIG. 11, FIG. 12, and FIG. 13. In this manner, the color coordinates of the white-based image may be adjusted as desired.

Figure 14:
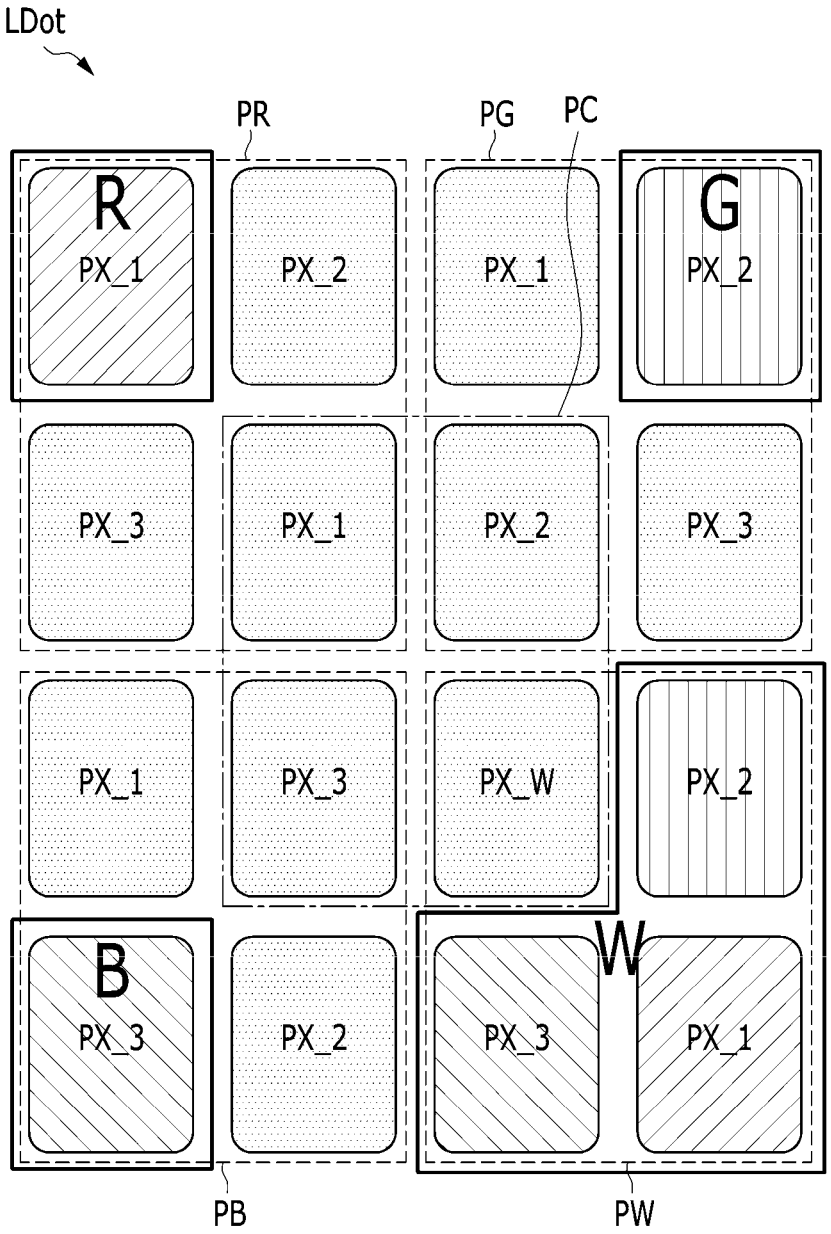

Next, referring to FIG. 14, a method of driving a display device according to a yet further exemplary embodiment is similar to that of the exemplary embodiment shown in FIG. 11, except for the pixel that is turned on in the fourth large pixel PW.

In detail, one of two first color pixels PX_1 in the first large pixel PR may be turned on to represent the red R, and the rest of the color pixels PX_1, PX_2, and PX_3 may be turned off. One of the two second colored pixels PX_2 included in the second large pixel PG may be turned on to represent the green G and the rest of the color pixels PX_1, PX_2, and PX_3 may be turned off. One of the two third color pixels PX_3 included in the third large pixel PB may be turned on to represent the blue B, and the rest of the color pixels PX_1, PX_2, and PX_3 may be turned off. The white pixel PX_W of the fourth large pixel PW may be turned off, and the rest of the color pixels PX_1, PX_2, and PX_3 may be turned on to represent the white color W.

In this case, the color coordinates of the white color represented by the fourth large pixel PW may be different from the color coordinates of the white color represented by the fourth large pixel PW in the exemplary embodiment shown in FIG. 11.

As described above, the red R represented by the first large pixel PR, the green G represented by the second large pixel PG, and the blue B represented by the third large pixel PB may be adjusted and combined by various methods as is known, thereby displaying images of various colors. In addition, the white color represented by the white pixel PX_W of the fourth large pixel PW may increase the luminance of the image represented by the large dot LDot.

Figure 15:
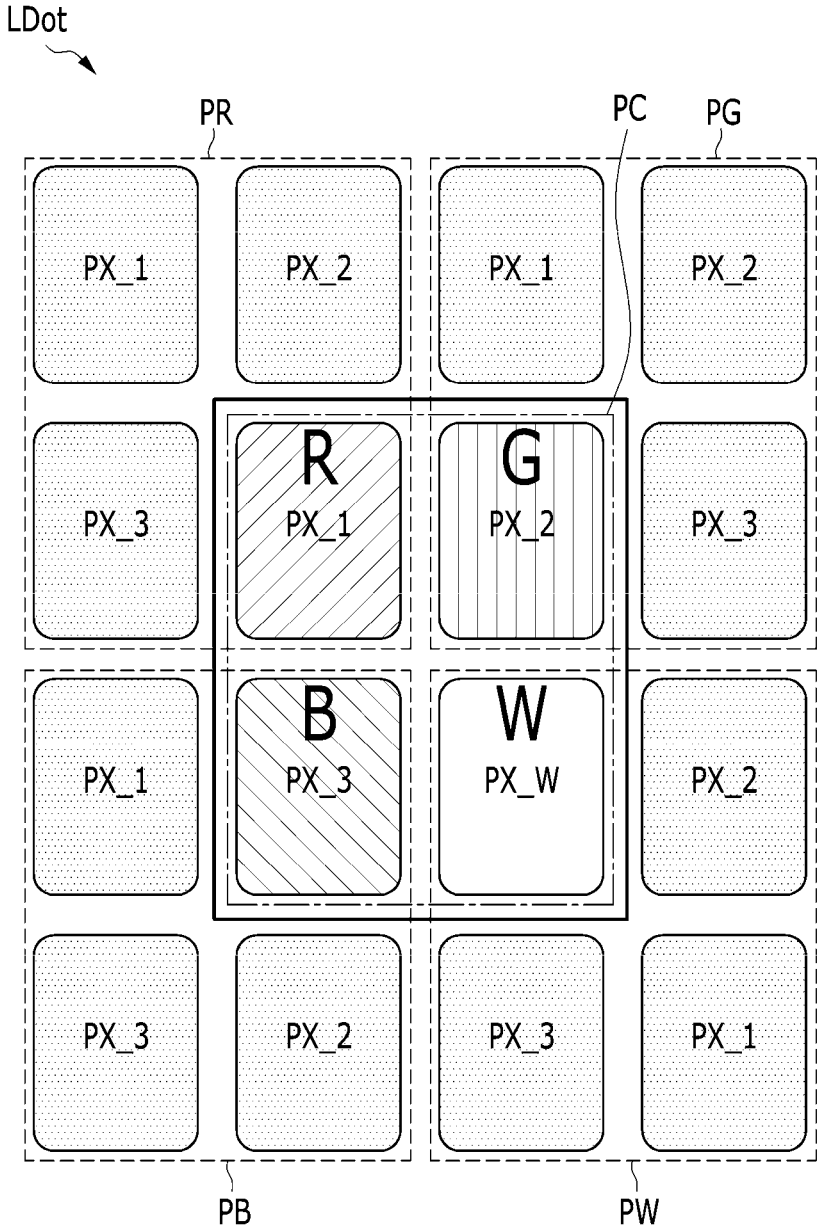

Next, referring to FIG. 15, a method of driving a display device according to an additional exemplary embodiment is similar to the exemplary embodiment shown in FIG. 11, however the pixel that is turned on may be different in the first to third large pixels PR, PG, and PB.

In detail, at least one of the first color pixel PX_1 turned on in the first large pixel PR, the second color pixel PX_2 turned on in the second large pixel PG, and the third color pixel PX_3 turned on in the third large pixel PB may be included in the fusion large pixel PC. FIG. 15 shows an example in which the lower right first color pixel PX_1 of first large pixel PR, the lower left second color pixel PX_2 of second large pixel PG, and the upper right third color pixel PX_3 of third large pixel PB are the pixels to be turned on, and are all located in the central fusion large pixel PC. Thus, the large pixel that is turned on in the large dot LDot may be the central fusion large pixel PC.

In the case of the present exemplary embodiment, the red R, the green G, and the blue B forming the image displayed by the large dot LDot are densely arranged (e.g., arranged close together, here adjacent to each other at the geometric center of LDot) as compared with the exemplary embodiment shown in FIG. 11 to FIG. 14 such that the characteristic of the displayed image may look different.

According to another exemplary embodiment of the present invention, the white pixel PX_W of the fusion large pixel PC may be turned off. In this case, the luminance of the displayed image may be decreased, when for example the display device is used in a dark environment.

Figure 16:
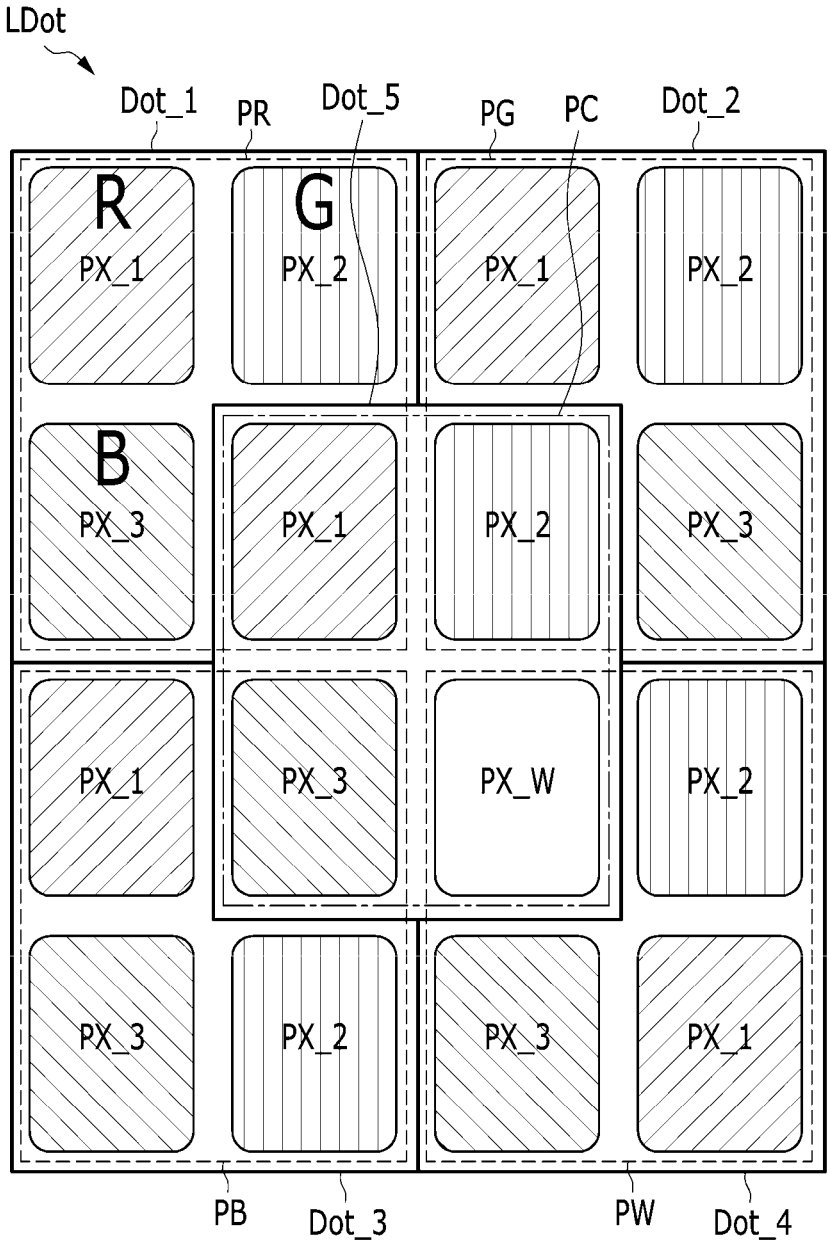
FIG. 16, FIG. 17, FIG. 18, FIG. 19, and FIG. 20 are layout views showing an example of a pixel that is driven when a large dot of a display device according to an exemplary embodiment of the present invention displays a plurality of images, respectively.

Next, referring to FIG. 16, one large dot LDot may include a plurality of dots Dot_1, Dot_2, Dot_3, Dot_4, and Dot_5 corresponding to each image signal. Each of the dots Dot_1, Dot_2, Dot_3, Dot_4, and Dot_5 may include various combinations of pixels PX_1, PX_2, PX_3, and PX_W so that various colors including white can be displayed.

FIG. 16 shows one large dot LDot including five dots Dot_1, Dot_2, Dot_3, Dot_4, and Dot_5. The five dots Dot_1, Dot_2, Dot_3, Dot_4, and Dot_5 may all be driven to display a high resolution image.

In detail, the first dot Dot_1 may include three color pixels PX_1, PX_2, and PX_3 representing the different primary colors included in the first large pixel PR; the second dot Dot_2 may include three color pixels PX_1, PX_2, and PX_3 representing the different primary colors included in the second large pixel PG; the third dot Dot_3 may include three color pixels PX_1, PX_2, and PX_3 representing the different primary colors included in the third large pixel PB; the fourth dot Dot_4 may include three color pixels PX_1, PX_2, and PX_3 representing the different primary colors included in the fourth large pixel PW; and the fifth dot Dot_5 may include four pixels PX_1, PX_2, PX_3, and PX_W included in the fusion large pixel PC. The dots have differing borders from the large pixels, as can be seen in FIG. 16.

Each of the dots Dot_1, Dot_2, Dot_3, Dot_4, and Dot_5 may display an image corresponding to each image signal, and particularly the fifth dot Dot_5 includes a white pixel PX_W such that an image of higher luminance may be displayed. Also, the image displayed by the fifth dot Dot_5, the luminance of the entire image displayed by the large dot LDot, and/or the color coordinates of the white color may each be controlled by controlling the on/off state of the white pixel PX_W of the fifth dot Dot_5.

Figure 17:
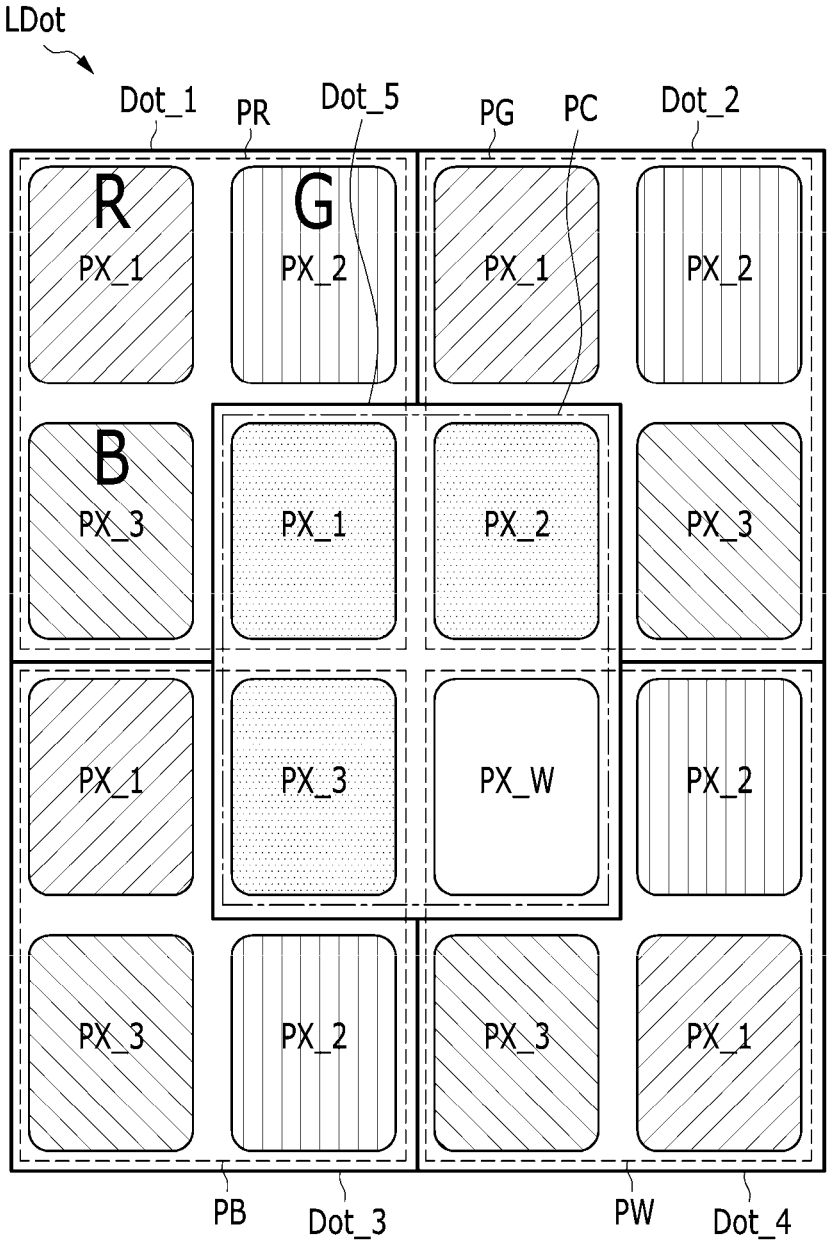

Next, referring to FIG. 17, a method of driving a display device according to a further exemplary embodiment is similar to the exemplary embodiment shown in FIG. 16, however the color pixels PX_1, PX_2, and PX_3 included in the fifth dot Dot_5 are each turned off and only the white pixel PX_W is driven. In addition, at least one among the rest of the dots Dot_1, Dot_2, Dot_3, and Dot_4, in detail, all dots Dot_1, Dot_2, Dot_3, and Dot_4, are driven according to the image signal.

Accordingly, as shown in FIG. 16, an image of lower resolution than the image displayed by driving all dots Dot_1, Dot_2, Dot_3, Dot_4, and Dot_5 may be displayed. The luminance of the displayed image may be appropriately controlled by controlling the on/off state of the white pixel PX_W.

Since the fifth dot Dot_5 is turned off (except for the white pixel PX_W), as shown in FIG. 16, an image of lower luminance than the image displayed by driving all dots Dot_1, Dot_2, Dot_3, Dot_4, and Dot_5 may be displayed. Accordingly, this driving method may be appropriate for use in situations such as a dark environment.

Figure 18:
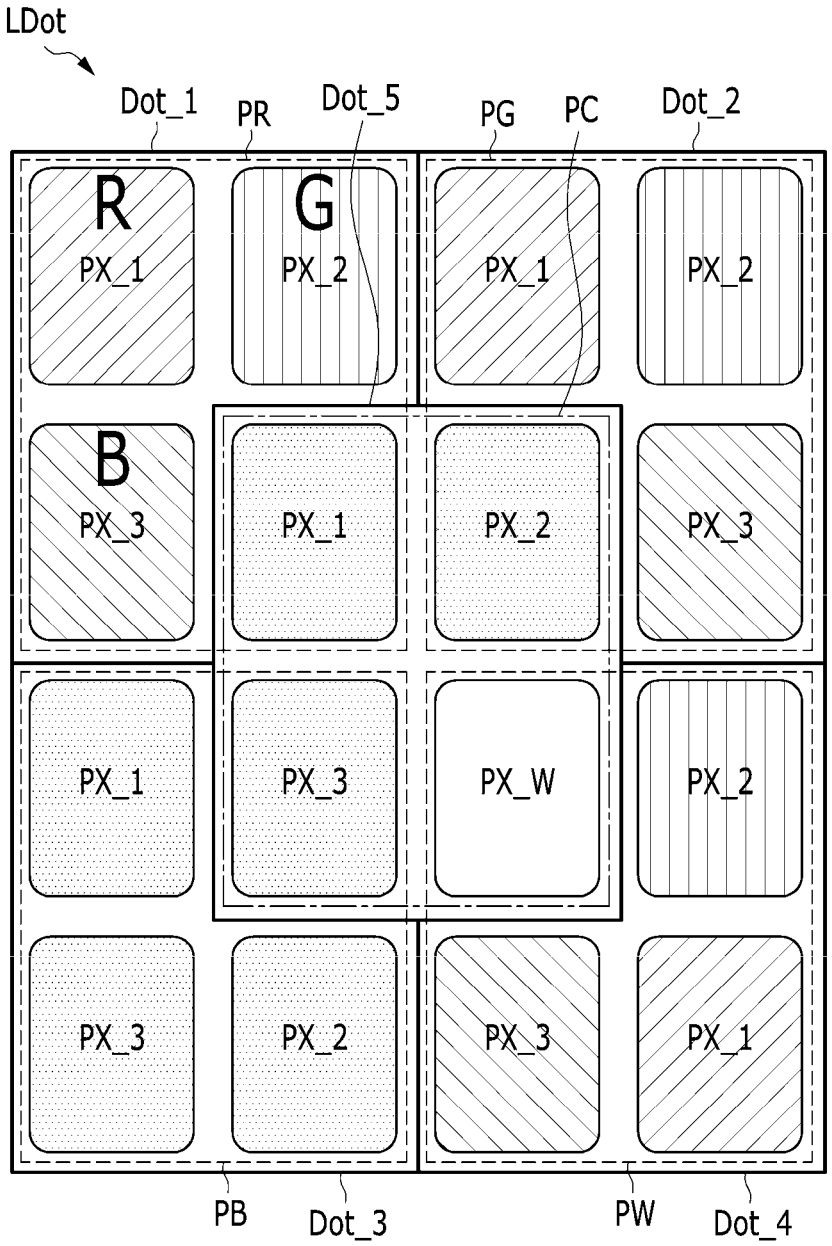

Next, referring to FIG. 18, a method of driving a display device according to a still further exemplary embodiment is similar to that of the exemplary embodiment shown in FIG. 17, however one among the dots Dot_1, Dot_2, Dot_3, and Dot_4, as well as the fifth dot Dot_5, may be turned off. FIG. 18 shows an example in which the third dot Dot_3 is turned off.

Accordingly, as shown in FIG. 17, an image of lower resolution than that displayed by driving all four dots Dot_1, Dot_2, Dot_3, and Dot_4 and/or the white pixel PX_W may be displayed. In the present exemplary embodiment, by controlling the on/off state of the white pixel PX_W, the luminance of the displayed image may be appropriately controlled.

Figure 19:
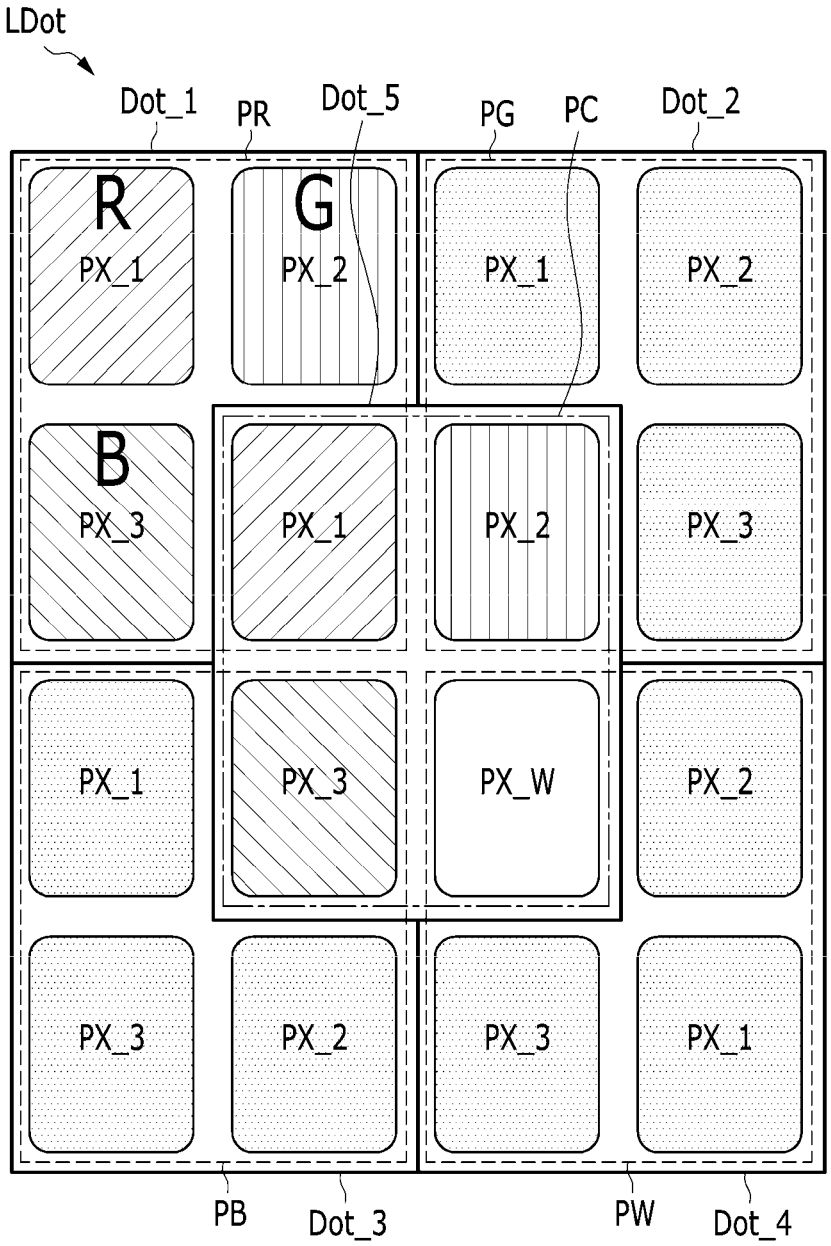

Next, referring to FIG. 19, a method of driving a display device according to an additional exemplary embodiment is similar to that of the exemplary embodiment shown in FIG. 17, however the fifth dot Dot_5 may be driven to be turned on while at least one of the first to fourth dots Dot_1, Dot_2, Dot_3, and Dot_4 are turned off and the rest are turned on. Particularly, FIG. 19 shows an example in which the first dot Dot_1 and the fifth dot Dot_5 among the dots Dot_1, Dot_2, Dot_3, Dot_4, and Dot_5 are driven.

Accordingly, as shown in FIG. 19, an image of lower resolution than the image displayed by driving three dots of one large dot LDot may be displayed. Since the fifth dot Dot_5 included in the white pixel PX_W may be driven to be turned on, the white pixel PX_W may be turned on or turned off to increase or decrease the luminance of the image as desired.

Figure 20:
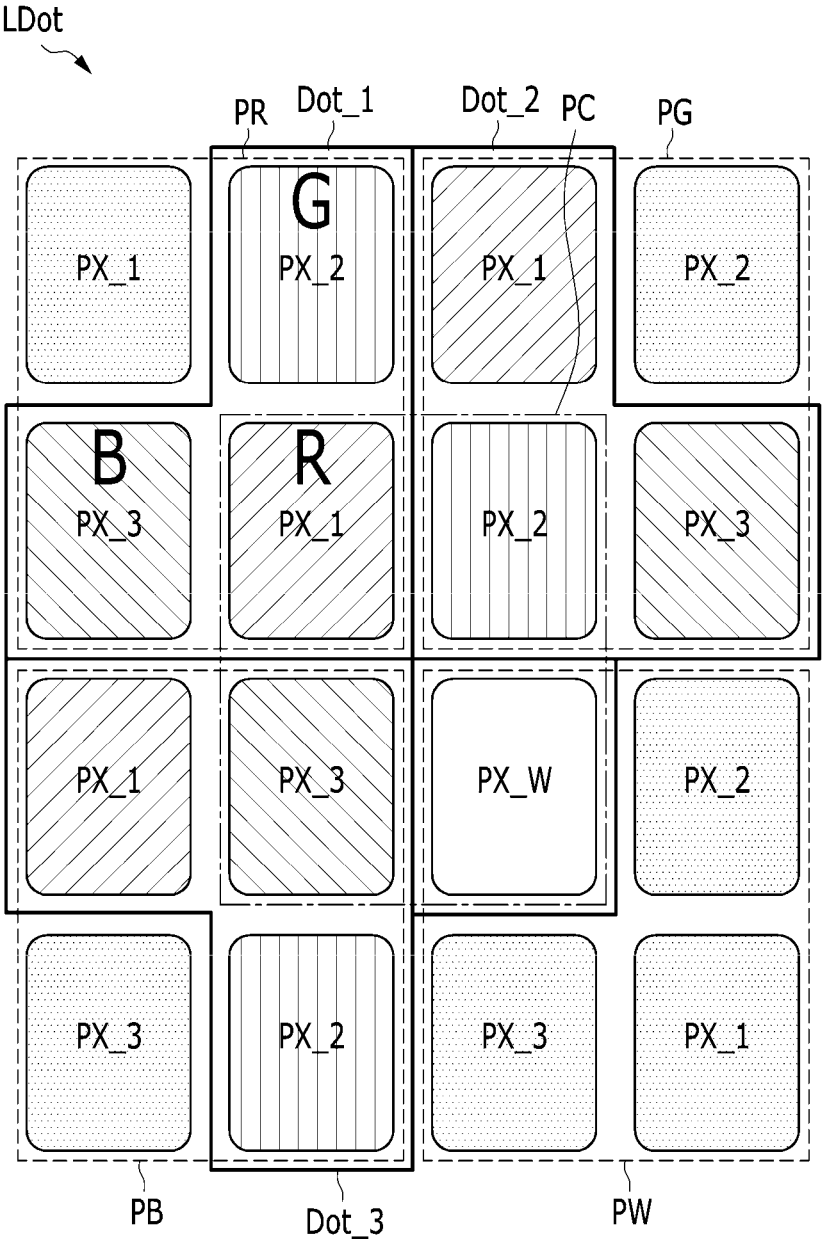

Next, referring to FIG. 20, the dots may be driven differently from the exemplary embodiment shown in FIG. 16. In detail, one large dot LDot may include three dots Dot_1, Dot_2, and Dot_3.

In detail, the first dot Dot_1 may include three color pixels PX_1, PX_2, and PX_3 representing three different colors and being within the first large pixel PR, the second dot Dot_2 may include three color pixels PX_1, PX_2, and PX_3 from the second large pixel PG, and the third dot Dot_3 may include three color pixels PX_1, PX_2, and PX_3 from the third large pixel PB. In this case, the first color pixel PX_1 of the first dot Dot_1, the second color pixel PX_2 of the second dot Dot_2, and the third color pixel PX_3 of the third dot Dot_3 may each be included in the fusion large pixel PC.

Each of the dots Dot_1, Dot_2, and Dot_3 may display an image corresponding to each image signal. The white pixel PX_W may also be driven. The luminance of the image and/or the color coordinates of the white color may be controlled by controlling the on/off state of the white pixel PX_W.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims. Furthermore, different features of the various embodiments, disclosed or otherwise understood, can be mixed and matched in any manner to produce further embodiments within the scope of the invention.

DESCRIPTION OF SYMBOLS

1: display panel
191: pixel electrode
DL, DL1, DL2: data line
Dot: dot
GL, GL1, GL2: gate line
LDot: large dot
PX_1, PX_2, PX_3: color pixel
PC: fusion large pixel
PR, PG, PB, PW: large pixel
PX_W: white pixel
Q: switching element

What is claimed is:

1. A display device comprising:
a plurality of large dots,
wherein each large dot includes a first large pixel, a second large pixel, a third large pixel, and a fourth large pixel disposed in a quadrangular configuration,
wherein the first large pixel includes two first color pixels each representing a first color, one second color pixel representing a second color, and one third color pixel representing a third color,
wherein the first color, the second color, and the third color are different from one another,
wherein the second large pixel includes two second color pixels, one first color pixel, and one third color pixel,
wherein the third large pixel includes two third color pixels, one first color pixel, and one second color pixel,
wherein the two second color pixels of the second large pixel and the two third color pixels of the third large pixel are respectively disposed in four consecutive pixel rows of the display device and are respectively disposed in four consecutive pixel columns of the display device.

2. The display device of claim 1, wherein:
the fourth large pixel includes one first color pixel, one second color pixel, one third color pixel, and one white pixel representing a white color.

3. The display device of claim 2, wherein:
one first color pixel of the first large pixel, one second color pixel of the second large pixel, one third color pixel of the third large pixel, and the white pixel of the fourth large pixel are adjacent to each other and disposed in a quadrangular configuration, thereby forming a fusion large pixel.

4. The display device of claim 3, wherein:
in the first large pixel,
the two first color pixels are disposed along a first diagonal direction, and
the second color pixel and the third color pixel are disposed along a second diagonal direction crossing the first diagonal direction.

5. The display device of claim 3, wherein:
in the second large pixel,
the two second color pixels are disposed along a first diagonal direction, and
the first color pixel and the third color pixel are disposed along a second diagonal direction crossing the first diagonal direction.

6. The display device of claim 3, wherein:
in the third large pixel,
the two third color pixels are disposed along a first diagonal direction, and
the first color pixel and the second color pixel are disposed along a second diagonal direction crossing the first diagonal direction.

7. The display device of claim 3, wherein:
in the fourth large pixel,
the white pixel and the first color pixel are disposed along a first diagonal direction, and the second color pixel and the third color pixel are disposed along a second diagonal direction crossing the first diagonal direction.

8. The display device of claim 3, wherein:

the first color is red, the second color is green, and the third color is blue.

9. A method of driving a display device, the method comprising receiving an image signal and displaying an image according to the image signal, wherein:

the display device includes a large dot including a first large pixel, a second large pixel, a third large pixel, and a fourth large pixel that are disposed in a quadrangular configuration, the first large pixel includes two first color pixels each representing a first color, one second color pixel representing a second color, and one third color pixel representing a third color, the second large pixel includes two second color pixels, one first color pixel, and one third color pixel, and the third large pixel includes two third color pixels, one first color pixel, and one second color pixel;

the first color, the second color, and the third color are different from one another; and when the image is displayed, only one or more of the two first color pixels of the first large pixel is turned on to display the first color of the image signal;

only one or more of the two second color pixels of the second large pixel is turned on to display the second color of the image signal; and only one or more of the two third color pixels of the third large pixel is turned on to display the third color of the image signal.

10. The method of claim 9, wherein when the image is displayed, the fourth large pixel displays only a white color of the image signal.

11. The method of claim 10, wherein:

the fourth large pixel includes one first color pixel, one second color pixel, one third color pixel, and one white pixel representing a white color, and the white pixel or the first through the third color pixels of the fourth large pixel is turned on to display the white color of the image signal.

12. A method of driving a display device, the method comprising receiving image signals and displaying an image according to the image signals, wherein:

the display device includes a large dot including a first large pixel, a second large pixel, a third large pixel, and a fourth large pixel that are disposed in a quadrangular configuration, the first large pixel includes two first color pixels each representing a first color, one second color pixel representing a second color, and one third color pixel representing a third color, the second large pixel includes two second color pixels, one first color pixel, and one third color pixel, and the third large pixel includes two third color pixels, one first color pixel, and one second color pixel;

the first color, the second color, and the third color are different from one another;

the two second color pixels of the second large pixel and the two third color pixels of the third large pixel are respectively disposed in four consecutive pixel rows of the display device and are respectively disposed in four consecutive pixel columns of the display device;

the large dot is divided into a plurality of small dots each including at least three adjacent pixels; and each of the plurality of small dots is independently driven according to a corresponding image signal of the image signals.

13. The method of claim 12, wherein:

the small dots each include one first color pixel, one second color pixel, and one third color pixel.

14. The method of claim 13, wherein:

the fourth large pixel includes one white pixel representing a white color, and one of the small dots further includes the white pixel.

15. The method of claim 13, wherein:

the fourth large pixel includes one white pixel representing a white color, and the white pixel is turned on when the images are displayed through the plurality of small dots.

* * * * *